US006183078B1

(12) United States Patent
Pietrzyk et al.

(10) Patent No.: US 6,183,078 B1
(45) Date of Patent: Feb. 6, 2001

(54) INK DELIVERY SYSTEM FOR HIGH SPEED PRINTING

(75) Inventors: Joe R. Pietrzyk; Yale Goldis; Kenneth J. Courian, all of San Diego, CA (US); Norman E. Pawlowski, Jr., Corvallis, OR (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 08/962,031

(22) Filed: Oct. 31, 1997

Related U.S. Application Data

(63) Continuation-in-part of application No. 08/748,726, filed on Nov. 13, 1996, now Pat. No. 5,815,185, and application No. 08/706,121, filed on Aug. 30, 1996, now Pat. No. 5,966,155, and application No. 08/608,376, filed on Feb. 28, 1996, now Pat. No. 5,874,974.

(51) Int. Cl.[7] ..... B41J 2/19

(52) U.S. Cl. ..... 347/92; 347/85; 347/40; 347/44

(58) Field of Search ..... 347/92, 85, 84, 347/86, 63, 65, 17, 18, 37, 40, 44

(56) References Cited

U.S. PATENT DOCUMENTS

| | | | | |
|---|---|---|---|---|
| 4,460,905 | | 7/1984 | Thomas | 347/54 |
| 4,509,062 | | 4/1985 | Low et al. | 347/87 |
| 4,677,447 | | 6/1987 | Nielsen | 347/87 |
| 4,804,944 | | 2/1989 | Golladay et al. | 340/624 |
| 4,882,595 | * | 11/1989 | Trueba et al. | 347/92 |
| 4,914,453 | | 4/1990 | Kanayama et al. | 347/87 |
| 4,940,997 | * | 7/1990 | Hamlin et al. | 346/140 R |
| 4,992,802 | * | 2/1991 | Dion et al. | 346/1.1 |
| 5,315,317 | | 5/1994 | Terasawa et al. | 347/7 |
| 5,325,119 | | 6/1994 | Fong | 347/86 |
| 5,367,328 | | 11/1994 | Erickson | 347/7 |
| 5,369,429 | * | 11/1994 | Erickson | 347/7 |
| 5,459,498 | | 10/1995 | Seccombe et al. | 347/18 |
| 5,506,608 | | 4/1996 | Marler et al. | 347/18 |
| 5,648,805 | * | 7/1997 | Keefe et al. | 347/55 |
| 5,835,111 | * | 11/1998 | Balazer | 347/50 |

FOREIGN PATENT DOCUMENTS

| | | | | |
|---|---|---|---|---|
| 0339770 | | 2/1989 | (EP) . | |
| 0 564 069 | | 10/1993 | (EP) | B41J/2/16 |
| 0 705 694 | | 4/1996 | (EP) | B41J/2/05 |
| 0 842 778 | | 5/1998 | (EP) | B41J/2/16 |
| 2134045 | * | 8/1994 | (GB) | 347/44 |
| 57-102364 | * | 6/1982 | (JP) | 347/44 |
| 57-169365 | * | 10/1982 | (JP) | 347/44 |
| 62-271750 | | 11/1987 | (JP) | B41J/3/04 |

* cited by examiner

*Primary Examiner*—John Barlow
*Assistant Examiner*—Juanita Stephens

(57) ABSTRACT

Disclosed is an ink delivery system for high throughput commercial inkjet printing devices. The ink delivery system includes a high speed ink ejection printhead with a large number of nozzles and an ink flow design which provides for improved printhead cooling. The printhead design achieves high ink ejection rates by having a very short inlet channel length which is made possible by having nozzles with a constant distance from the edge of the printhead. In order to accommodate this constant distance from the edge of the printhead the entire array of nozzles is disposed at a angle relative to the direction normal to the scan direction. An impinging ink flow against the back of the printhead is provided to limit the temperature of the printhead. A bubble collection chamber to increase the life of the printhead and a pressure regulator to provide ink at a controlled pressure to the printhead may also be provided. Pressurized ink may be provided so that ink pressure may be properly controlled even during peak usage.

34 Claims, 20 Drawing Sheets

INK DELIVERY SYSTEM FOR HIGH SPEED PRINTING

CROSS-REFERENCE TO RELATED APPLICATIONS

This application is a continuation-in-part of U.S. patent application Ser. No. 08/748,726, filed Nov. 13, 1996, now U.S. Pat. No. 5,815,185 entitled "Ink Flow Heat Exchanger for Inkjet Printhead;" U.S. patent application Ser. No. 08/706,121, filed Aug. 30, 1996, now U.S. Pat. No. 5,966, 155, entitled "Inkjet Printing System with Off-Axis Ink Supply Having Ink Path Which Does Not Extend above Print Cartridge"; and U.S. patent application Ser. No. 08/608,376, filed Feb. 28, 1996, now U.S. Pat. No. 5,874, 974 entitled "Reliable High Performance Drop Generator For an Inkjet Printhead." The foregoing commonly assigned patent applications are herein incorporated by reference.

FIELD OF THE INVENTION

This invention relates to inkjet printers and, more particularly, to a printhead with an ink delivery system that provides for high speed printing.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", "or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

To increase resolution and print quality, the printhead nozzles must be placed closer together. This requires that both heater resistors and the associated orifices be placed closer together. To increase printer throughput, the width of the printing swath must be increased by placing more nozzles on the print head. An increased number of heater resistors spaced closer together creates a much greater concentration of heat generation, greater likelihood of crosstalk and increased difficulty in supplying ink to each vaporization chamber quickly.

In an inkjet printhead ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed". In center feed the ink then flows through a central slot in the substrate into a central manifold area formed in a barrier layer between the substrate and a nozzle member, then into a plurality of ink channels, and finally into the various vaporization chambers. In edge feed ink from the ink reservoir flows around the outer edges of the substrate into the ink channels and finally into the vaporization chambers. In either center feed or edge feed, the flow path from the ink reservoir and the manifold inherently provides restrictions on ink flow to the firing chambers. Thus, another concern with inkjet printing is the sufficiency of ink flow to the printhead. Print quality is a function of ink flow through the printhead.

Too little ink on the paper or other media to be printed upon produces faded and hard-to-read documents.

Previous printheads when operating at a high ink ejection rates have had cooling problems because the flow of ink across the back surface of the printhead is insufficient to adequately cool the printhead. When the temperature of the printhead gets too high print quality is degraded. This is because the printhead is finely tuned to operate optimally within a narrow temperature range because ink properties and the characteristics of bubble nucleation and growth are strongly dependent on temperature and the printhead does not perform well outside this temperature range.

Air and other gas bubbles and particulate matter can also cause major problems in ink delivery systems. Ink delivery systems are capable of releasing gasses and generating bubbles, thereby causing systems to get clogged and degraded by bubbles. In the design of a good ink delivery system, it is important that techniques for eliminating or reducing bubble problems be considered. Therefore, another problem that occurs during the life of the print element is air out-gassing. Air builds up between the filter and the printhead during operation of the printhead. For printers that have a high use model, it would be preferable to have a larger volume between the filter and the printhead for the storage of air. For low use rate printers, this volume would be reduced.

There is a need for high speed printing devices, such as large format printers, high speed printers and copiers. In the past, printheads have not had the high speed ink ejection rates required for high speed printing rates. Thus, it is desirable to modify printhead design to provide better cooling of the printhead while avoiding any bubble accumulation which could starve the printhead.

Accordingly, there is a need for a printing system having an ink delivery system that overcomes thermal problems and minimizes air accumulation while providing sufficient volume for air accumulation at high speed printing rates.

SUMMARY OF THE INVENTION

The above invention has advantages for an ink delivery system for high throughput commercial inkjet printing devices. The ink delivery system includes a high speed ink ejection printhead with a large number of nozzles and an ink flow design which provides for improved printhead cooling. The printhead design achieves high ink ejection rates by having a very short shelf length which is made possible by having nozzles with a constant distance from the edge of the printhead. In order to accommodate this constant distance from the edge of the printhead the entire array of nozzles is disposed at a angle relative to the direction normal to the scan direction. An impinging ink flow against the back of the printhead is provided to limit the temperature of the printhead. A bubble collection chamber to increase the life of the printhead and a pressure regulator to provide ink at a controlled pressure to the printhead may also be provided. Pressurized ink may be provided so that ink pressure may be properly controlled even during peak usage.

DETAILED DESCRIPTION OF THE PREFERRED EMBODIMENTS

Figure 1:
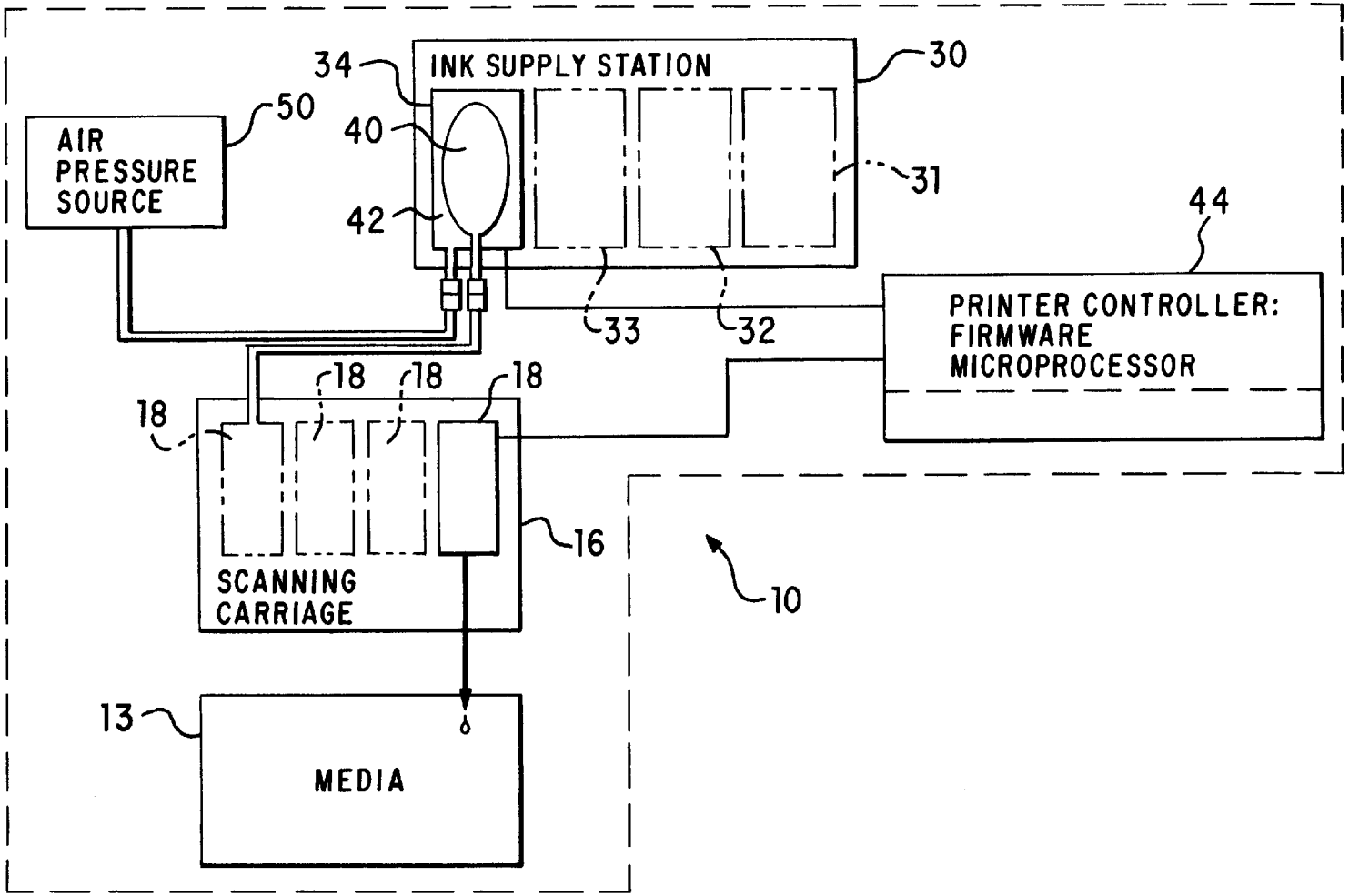
FIG. 1 is a block diagram of an overall printing system incorporating the present invention.

FIG. 1 shows a block diagram of an overall printing system 10 incorporating the present invention. A printer controller 44 controls the printer operations in accordance with signals it receives from a computer (not shown). A scanning carriage 16 holds a plurality of high performance print cartridges 18 that are fluidically coupled to an ink supply station 30. The supply station provides pressurized ink to the print cartridges 18. Each cartridge has a regulator valve that opens and closes to maintain a slight negative gauge pressure in the cartridge that is optimal for printhead performance. The ink may be pressurized to eliminate effects of dynamic pressure drops associated with high throughput printing.

The ink supply station 30 contains receptacles or bays for slidable mounting ink containers 31–34. Each ink container has a collapsible ink reservoir, such as reservoir 40 that is surrounded by an air pressure chamber 42. An air pressure source or pump 50 is in communication with the air pressure chamber 42 for pressurizing the collapsible reservoir 40. Pressurized ink is than delivered to the print cartridge, e.g. cartridge 18, by an ink flow path. One air pump supplies pressurized air for all ink containers in the system. In an exemplary embodiment, the pump supplies a positive pressure of 2 psi, in order to meet ink flow rates on the order of 25 cc/min. Of course, for systems having lower ink flow rate requirement, a lower pressure will suffice, and some cases with low throughput rates will require no positive air pressure at all.

Figure 2:
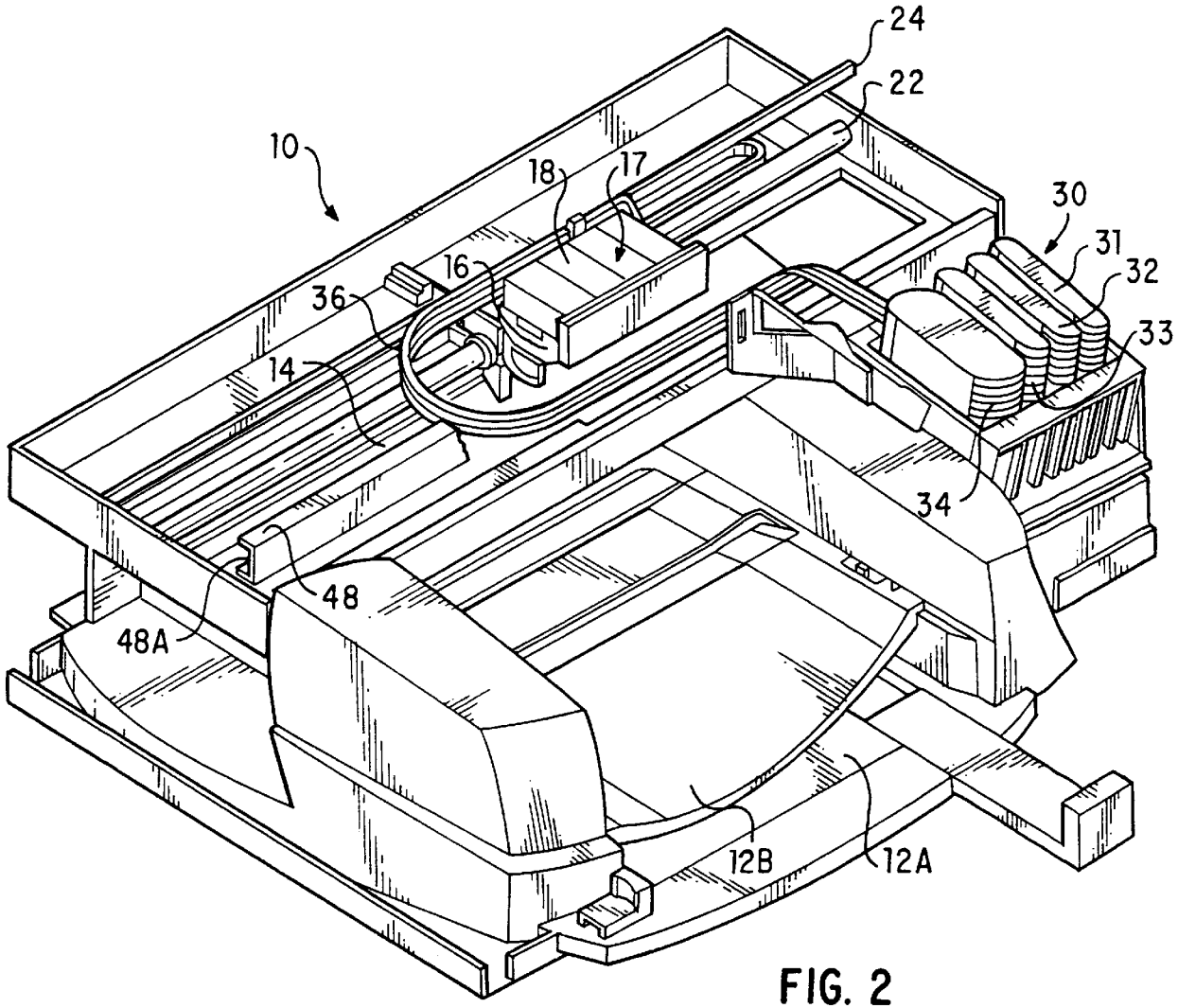
FIG. 2 is a perspective view of one embodiment of an inkjet printer incorporating the present invention.

While the present invention will be described below in the context of an off-axis printer having an external ink source, it should be apparent that the present invention is also useful in an inkjet printer which uses inkjet print cartridges having an ink reservoir integral with the print cartridge. FIG. 2 is a perspective view of one embodiment of an inkjet printer 10 suitable for utilizing the filter carrier assembly of the present invention, with its cover removed. Generally, printer 10 includes a tray 12 for holding media 13 (not shown). When a printing operation is initiated, a sheet of media from tray 12A is fed into printer 10 using a sheet feeder, then brought around in a U direction to now travel in the opposite direction toward tray 12B. The sheet is stopped in a print zone 14, and a scanning carriage 16, supporting one or more print cartridges 18, is then scanned across the sheet for printing a swath of ink thereon. After a single scan or multiple scans, the sheet is then incrementally shifted using a conventional stepper motor and feed rollers to a next position within the print zone 14, and carriage 16 again scans across the sheet for printing a next swath of ink. When the printing on the sheet is complete, the sheet is forwarded to a position above tray 12B, held in that position to ensure the ink is dry, and then released.

The carriage 16 scanning mechanism may be conventional and generally includes a slide rod 22, along which carriage 16 slides, a flexible circuit (not shown in FIG. 2) for transmitting electrical signals from the printer's microprocessor to the carriage 16 and print cartridges 18 and a coded strip 24 which is optically detected by a photo detector in carriage 16 for precisely positioning carriage 16. A stepper motor (not shown), connected to carriage 16 using a conventional drive belt and pulley arrangement, is used for transporting carriage 16 across print zone 14.

The features of inkjet printer 10 include an ink delivery system for providing ink to the print cartridges 18 and ultimately to the ink ejection chambers in the printheads from an off-axis ink supply station 30 containing replaceable ink supply cartridges 31, 32, 33, and 34, releasably mounted in an ink supply station 30 and which may be pressurized or at atmospheric pressure. For color printers, there will typically be a separate ink supply cartridge for black ink, yellow ink, magenta ink, and cyan ink. Four tubes 36 carry ink from the four replaceable ink supply cartridges 31–34 to the print cartridges 18.

Figure 3:
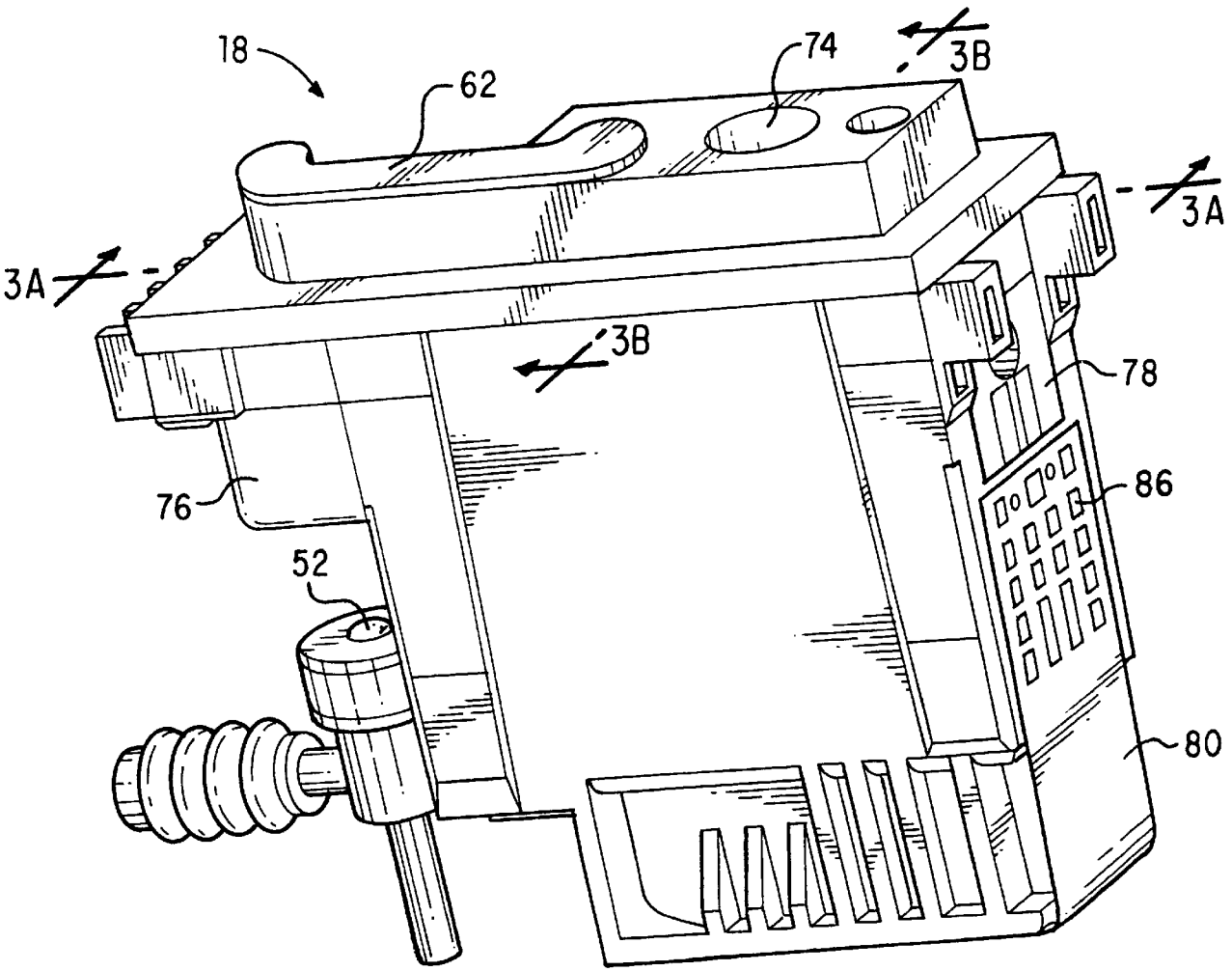
FIG. 3 is a top perspective view of a single print cartridge and also showing the fluid interconnect portion of the carriage.

FIG. 3 is a perspective view of one embodiment of a print cartridge 18. A shroud 76 surrounds needle 60 (obscured by shroud 76) to prevent inadvertent contact with needle 60 and also to help align septum 52 with needle 60 when installing print cartridge 18 in carriage 16. A flexible tape 80 containing contact pads 86 leading to the printhead substrate is secured to print cartridge 18. An integrated circuit chip 78 provides feedback to the printer regarding certain parameters of print cartridge 18. These contact pads 86 align with and electrically contact electrodes (not shown) on carriage 16. Preferably, the electrodes on carriage 16 are resiliently biased toward print cartridge 18 to ensure a reliable contact. Such carriage electrodes are found in U.S. Pat. No. 5,408,746, entitled Datum Formation for Improved Alignment of Multiple Nozzle Members in a Printer assigned to the present assignee and incorporated herein by reference.

Figure 4:
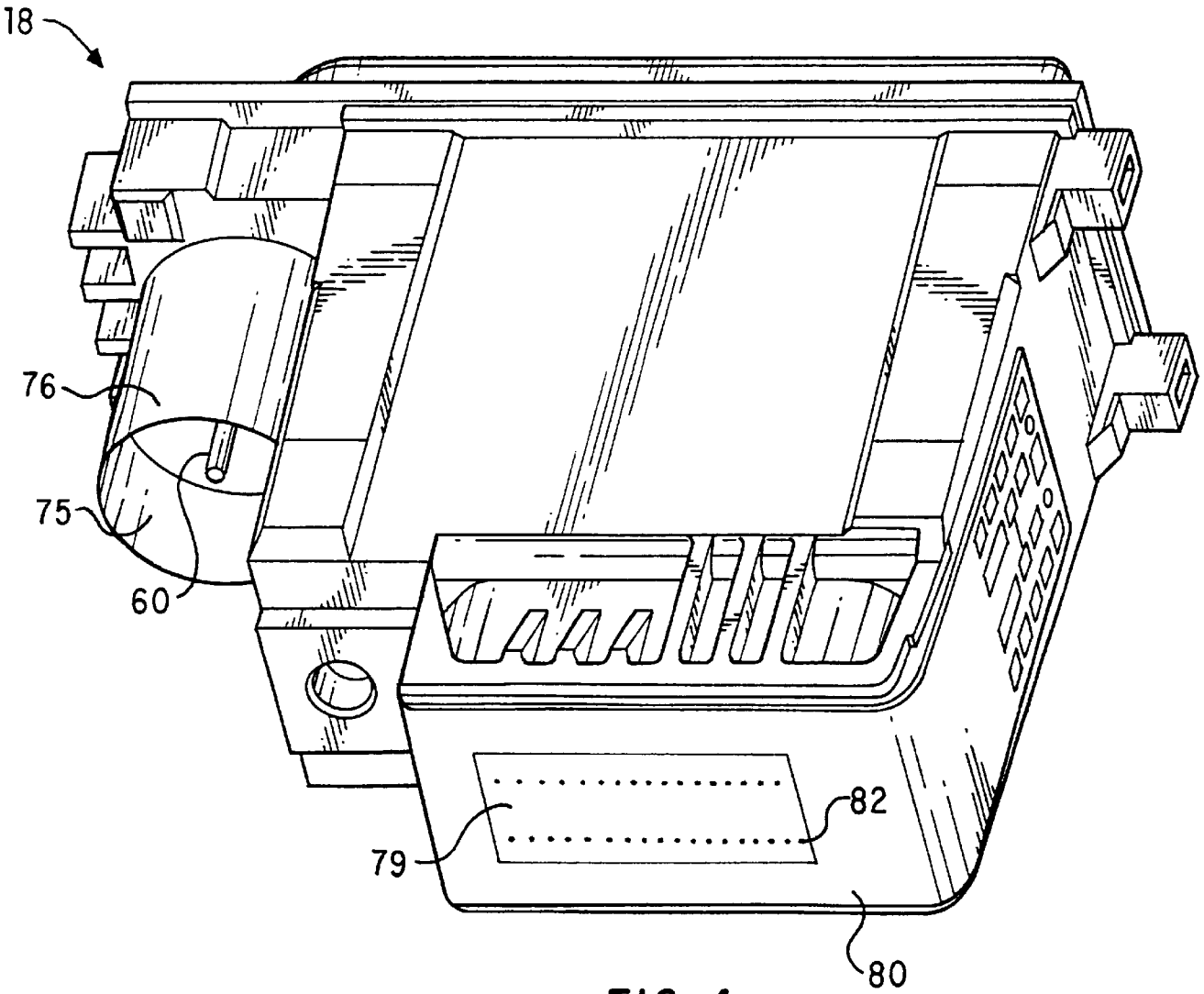
FIG. 4 is a bottom perspective view a single print cartridge and the fluid interconnect portion of the carriage.

FIG. 4 shows the bottom side of print cartridge 18. Two parallel rows of offset nozzles 82 are shown laser ablated through tape 80.

Figure 5:
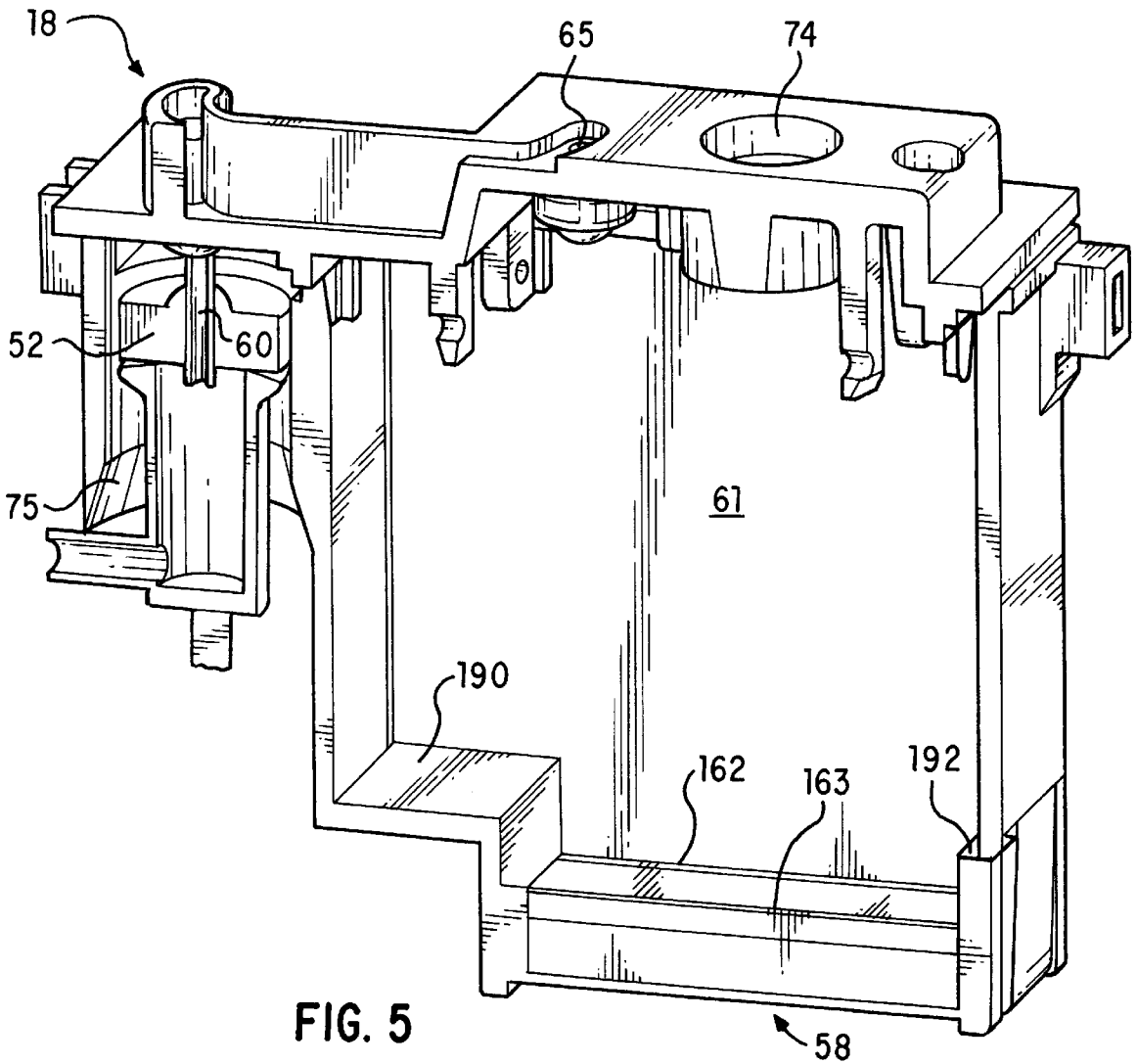
FIG. 5 is a cross-sectional, perspective view along line A—A of the print cartridge of FIG. 3 shown connected to the fluid interconnect on the carriage.

FIG. 5 is a cross-sectional view of print cartridge 18, without tape 80, taken along line 3A—3A in FIG. 3. Shroud 76 is shown having an inner conical or tapered portion 75 to receive septum 52 and center septum 52 with respect to needle 60. A valve (not shown) within print cartridges 18 regulates pressure by opening and closing an inlet hole 65 to ink chamber 61 internal to print cartridges 18. The ink valve is automatically opened and closed by an internal ink pressure regulator which senses the pressure difference between the ambient pressure and the pressure internal to the ink chamber, so as to maintain a relatively constant negative pressure within the ink chamber. This negative pressure prevents ink drooling from nozzles 82. For a detailed description of the design and operation of the regulator see U.S. Pat. application Ser. No. 08/706,121, filed Aug. 30, 1996, now U.S. Pat. No. 5,966,155, entitled "Inkjet Printing System with Off-Axis Ink Supply Having Ink Path Which Does Not Extend above Print Cartridge," and U.S. application Ser. No. 08/550,902, filed Oct. 31, 1995, now U.S. Pat. No. U.S. Pat. No. 5,872,584, entitled "Apparatus for Providing Ink to an Ink-Jet Print Head and for Compensating for Entrapped Air" which are herein incorporated by reference.

When the regulator valve is opened, a hollow needle 60 is in fluid communication with an ink chamber 61 internal to the cartridge 18. The needle 60 extends through a self-sealing hole formed in through the center of the septum 52. The hole is automatically sealed by the resiliency of the rubber septum 52 when the needle is removed. A plastic conduit 62 leads from the needle 60 to chamber 61 via hole 65. The conduit may be glued, heat-staked, ultrasonically welded or otherwise secured to the print cartridge body. The conduit may also be integral to the print cartridge body. Surfaces 190, 192 support the filter carrier 200 which will be described below.

Figure 6:
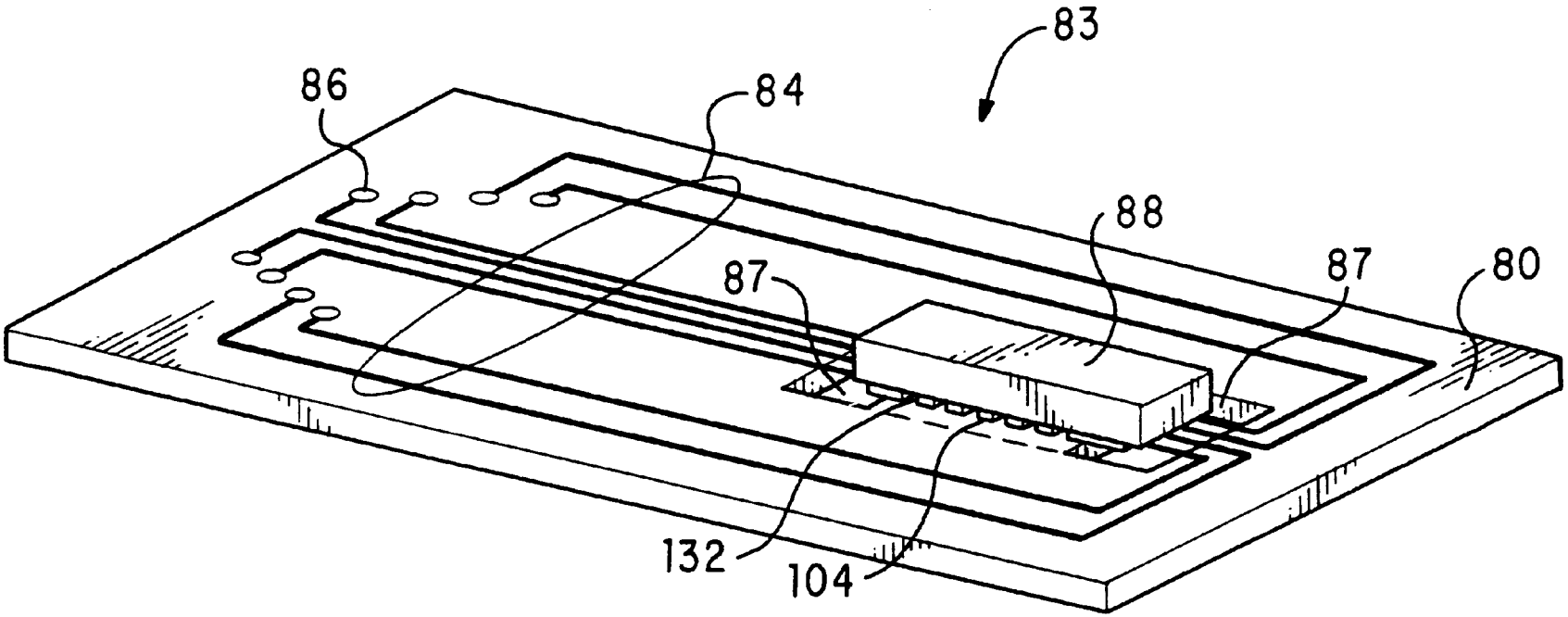
FIG. 6 is a schematic perspective view of the back side of the printhead assembly.

Referring to FIGS. 4 and 6, printhead assembly 83 is preferably a flexible polymer tape 80 having nozzles 82 formed therein by laser ablation. Conductors 84 are formed on the back of tape 80 and terminate in contact pads 86 for contacting electrodes on carriage 16. The other ends of conductors 84 are bonded to terminals or electrodes 87 of a substrate 88 on which are formed the various ink ejection chambers and ink ejection elements. The ink ejection elements may be heater resistors or piezoelectric elements.

A demultiplexer (not shown) may be formed on substrate 88 for demultiplexing the incoming multiplexed signals applied to the electrodes 87 on the substrate and distributing the address and primitive signals to the various ink ejection elements 96 to reduce the number of contact pads 86 required. The incoming multiplexed signals include address line and primitive firing signals. The demultiplexer enables the use of fewer contact pads 86, and thus electrodes 87 than, ink ejection elements 96. The demultiplexer may be any decoder for decoding encoded signals applied to the electrodes 87. The demultiplexer has input leads (not shown for simplicity) connected to the electrodes 87 and has output leads (not shown) connected to the various ink ejection elements 96. The demultiplexer decodes the incoming electrical signals applied to contact pads 86 and selectively energizes the various ink ejection elements 96 to eject droplets of ink from nozzles 82 as nozzle array 79 scans across the print zone. Further details regarding multiplexing are provided in U.S. Pat. No. 5,541,269, issued Jul. 30, 1996, entitled "Printhead with Reduced Interconnections to a Printer," which is herein incorporated by reference.

Preferably, an integrated circuit logic using CMOS technology should be placed on substrate 88 in place of the demultiplexer in order to decode more complex incoming data signals than just multiplexed address signals and primitive signals, thus further reducing the number of contact pads 86 required. The incoming data signals are decoded in the integrated logic circuits on the printhead into address line and primitive firing signals. Performing this operation in the integrated logic circuits on the printhead increases the signal processing speed.

The printhead assembly may be similar to that described in U.S. Pat. No. 5,278,584, by Brian Keefe, et al., entitled "Ink Delivery System for an Inkjet Printhead," assigned to the present assignee and incorporated herein by reference. In such a printhead assembly, ink within print cartridge 18 flows around the edges of the rectangular substrate 88 and into ink inlet channels 132 leading to each of the ink ejection chambers.

Figure 7:
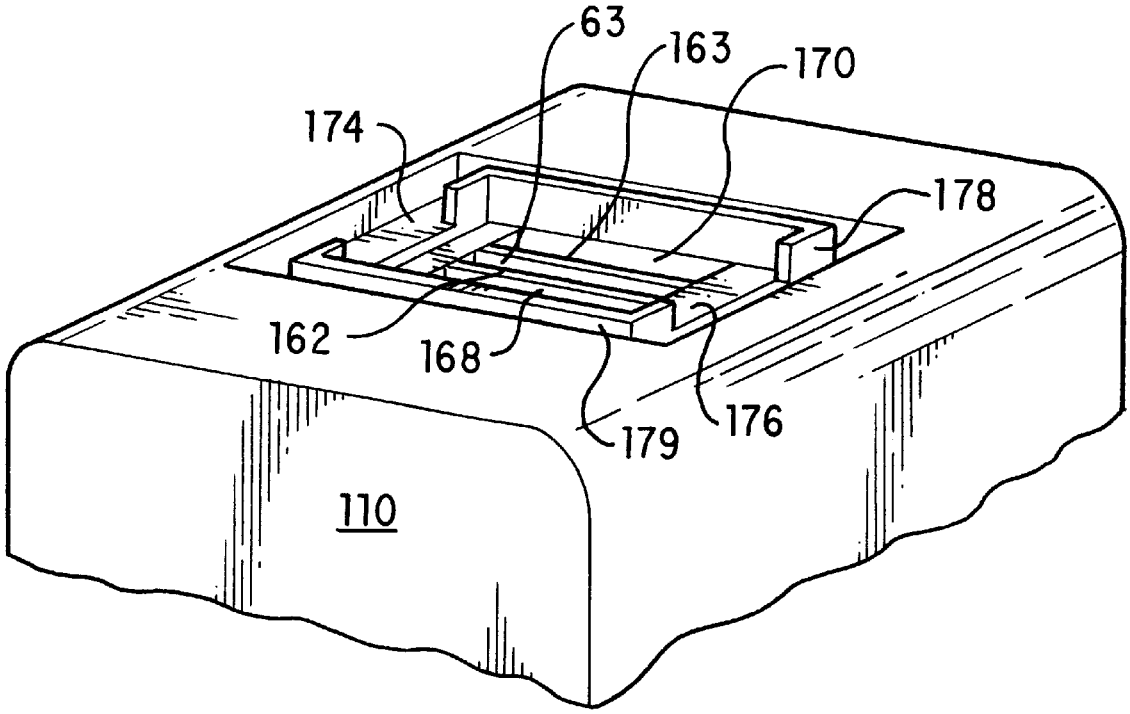
FIG. 7 is a perspective view the of print cartridge of FIG. 3 showing the headland area where the substrate and flex tape are attached.

FIG. 7 is perspective view of the headland area of print cartridge body 110 of print cartridge 18 with the tape 80 removed along with substrate 88 to reveal walls 162 and 163, ink conduit 63, and chambers 168 and 170. An adhesive/sealant is applied to headland area 110 along the top and sides of inner walls 178, 179 and at inner wall openings 174, 176. The tape 80 and substrate 88 assembly 83 of FIG. 6 is then secured to the headland 110 of print cartridge 18.

Figure 8:
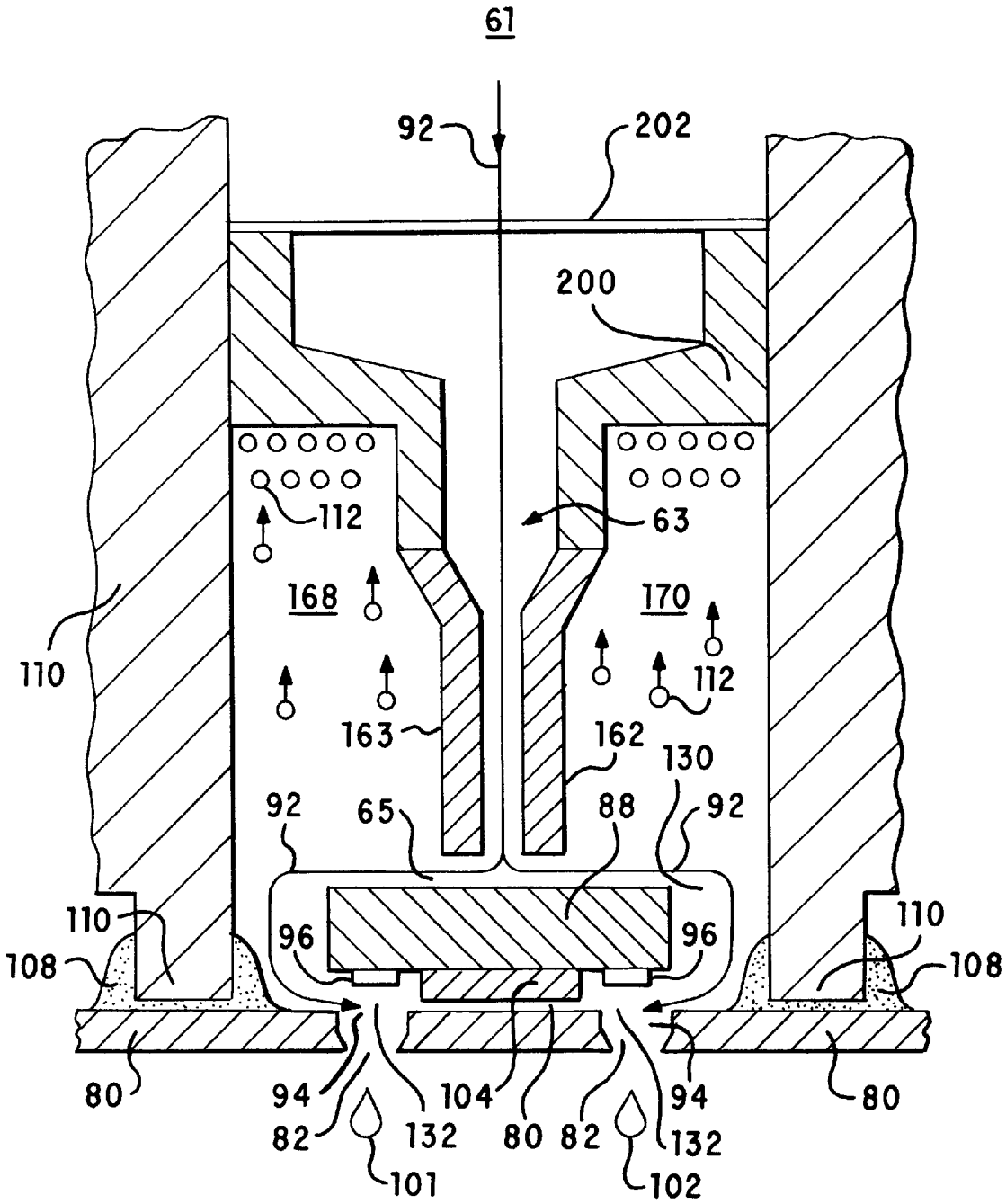
FIG. 8 is a cross-sectional view along line B—B of FIG. 3 of an edge feed printhead illustrating a portion of the printhead assembly and showing the flow of ink along the back of the substrate and into the ink ejection chambers in the printhead.

FIG. 8 illustrates the flow of ink 92 from the ink chamber 61 within print cartridge 18 to ink ejection chambers 94. Ink chamber 61 is in fluid communication with the ink supplies 31–34 as discussed above. Energization of the ink ejection elements 96 cause a droplet of ink 101, 102 to be ejected through the associated nozzles 82. A photo resist barrier layer 104, the flexible tape 80 and substrate 88 define the ink inlet channels 132 and chambers 94. The conductor portion of the flexible tape 80 is glued with adhesive 108 to the plastic print cartridge body 110.

The plastic print cartridge body 110 is formed such that the ink conduit 63 directs the flow of ink 92 from a chamber 61 within the print cartridge 18 towards the back of the substrate 88 and through a narrow gap 65 that exists between the back surface of substrate 88 and the walls 162 and 163. The gap 65 at the end of ink conduit 63 is much narrower than the gap between the ink conduit and substrate 88 in prior print cartridges. The ink 92 then flows into an ink channel 130 along the back surface of substrate 88, around the edge of substrate 88 and into inlet channel 132. The filter carrier 200 and the walls 162 and 163 direct the flow of ink 92 through the ink conduit 63. The walls 162 and 163 of the ink conduit 63 terminate approximately 0.127 mm (5 mils) from the back of the substrate 88, thereby forming the narrow gap. An acceptable range for this gap 65 is from about 3 mils to about 12 mils, depending on the ink viscosity and flow rates. The distance, in the preferred embodiment, between walls 162 and 163 is approximately 1 mm. The distance between walls 162 and 163 may be anywhere between about 1 mm and 5 mm. Other distances may also be suitable depending upon the size of substrate 88, ink viscosity, and flow rates. The thickness of walls 162 and 163 is about 0.5 mm, but thinner or thicker walls will also work. Increasing wall thickness improves heat transfer from the substrate to the ink, but also creates an increase flow restriction. The lower limit is dependent more on manufacturing tolerances than on thermal performance of the device.

Although the volume of ink is ejected from nozzles 82 may be the same as previous print cartridges, the ink velocity across the back of substrate 88 is much higher due to the narrower gap 65 that exits at the end of ink conduit 63 relative to the large area available for flow everywhere in ink conduit 63. The increased ink velocity caused by the proximity of the ends of walls 162 and 163 to the back of substrate 88 cause a relatively large transfer of heat from the back of substrate 88 to the moving ink. The heated ink flows around the edges of substrate 88 and into the ink ejection chambers 94.

Figure 9:
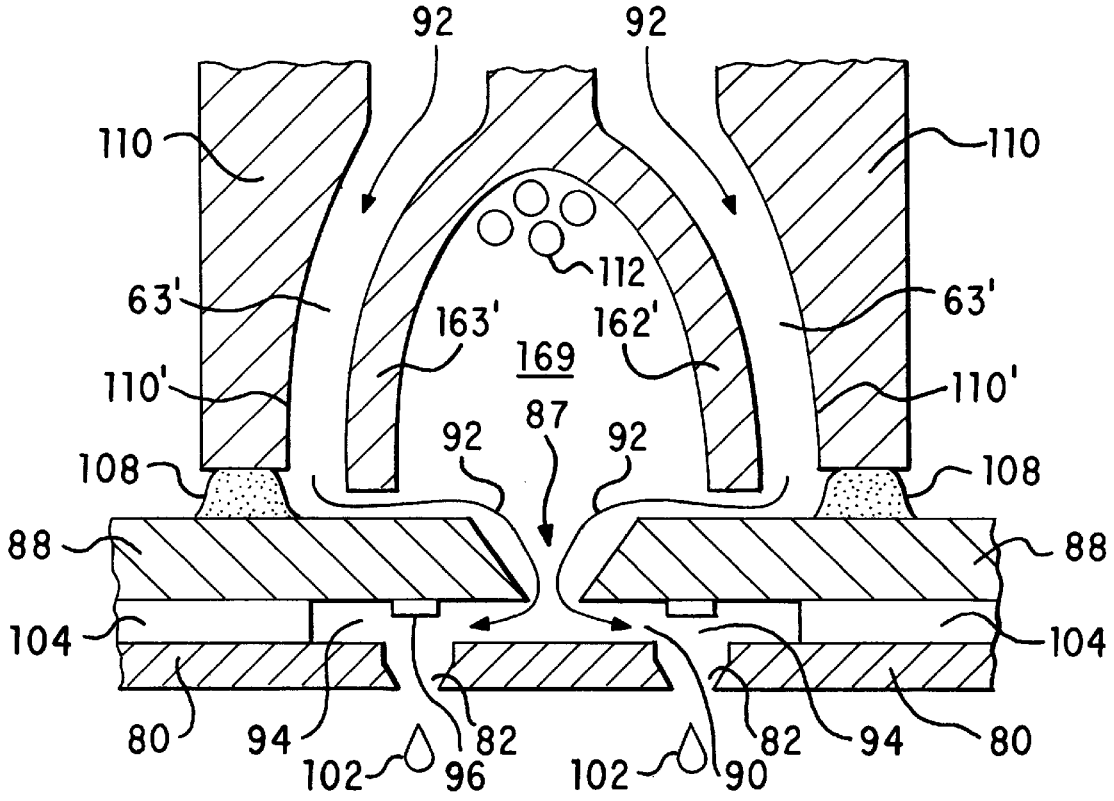
FIG. 9 is a cross-sectional view along line B—B of FIG. 3 of a center feed printhead illustrating a portion of the printhead assembly and showing the flow of ink along the back of the substrate and into the ink ejection chambers in the printhead.

The inventive concepts described above for increasing the velocity of ink flowing across a substrate while avoiding the possibility of bubbles blocking the ink conduit may be applied to other types of printheads. For example, FIG. 9 shows a center feed printhead using impinging flow, wherein ink conduits 63' are formed by walls 162', 163' and the inner wall 110' of cartridge body 110. The narrow gaps 65' formed between the back of the substrate 88 and walls 162' and 163' cause the ink 92 at relatively high velocity to run along a larger surface area of substrate 88 to remove heat from substrate 88 before proceeding through the center ink slot 87 of substrate 88. A central bubble accumulation chamber 169 is shown which accumulates bubbles 112 which have out-diffused from the ink 92 as the ink is heated by substrate 88. The complete structure of the printhead illustrated in FIG. 9 would be readily understood by one skilled in the art. For further details of a center feed printhead see U.S. Pat. No. 5,815,185, entitled "Ink Flow Heat Exchanger for Inkjet Printhead."

The added heat withdrawn from the substrate due to the novel ink conduit allows the printhead to operate at higher speeds without adversely affecting the print quality. The enhanced thermal performance does not rely on any attachments to the substrate, such as a heat exchanger. Such attachments would likely be much more complex and costly. The print cartridge may be a single-use disposable cartridge, a refillable cartridge, or a cartridge connected to an external ink supply.

Figure 10:
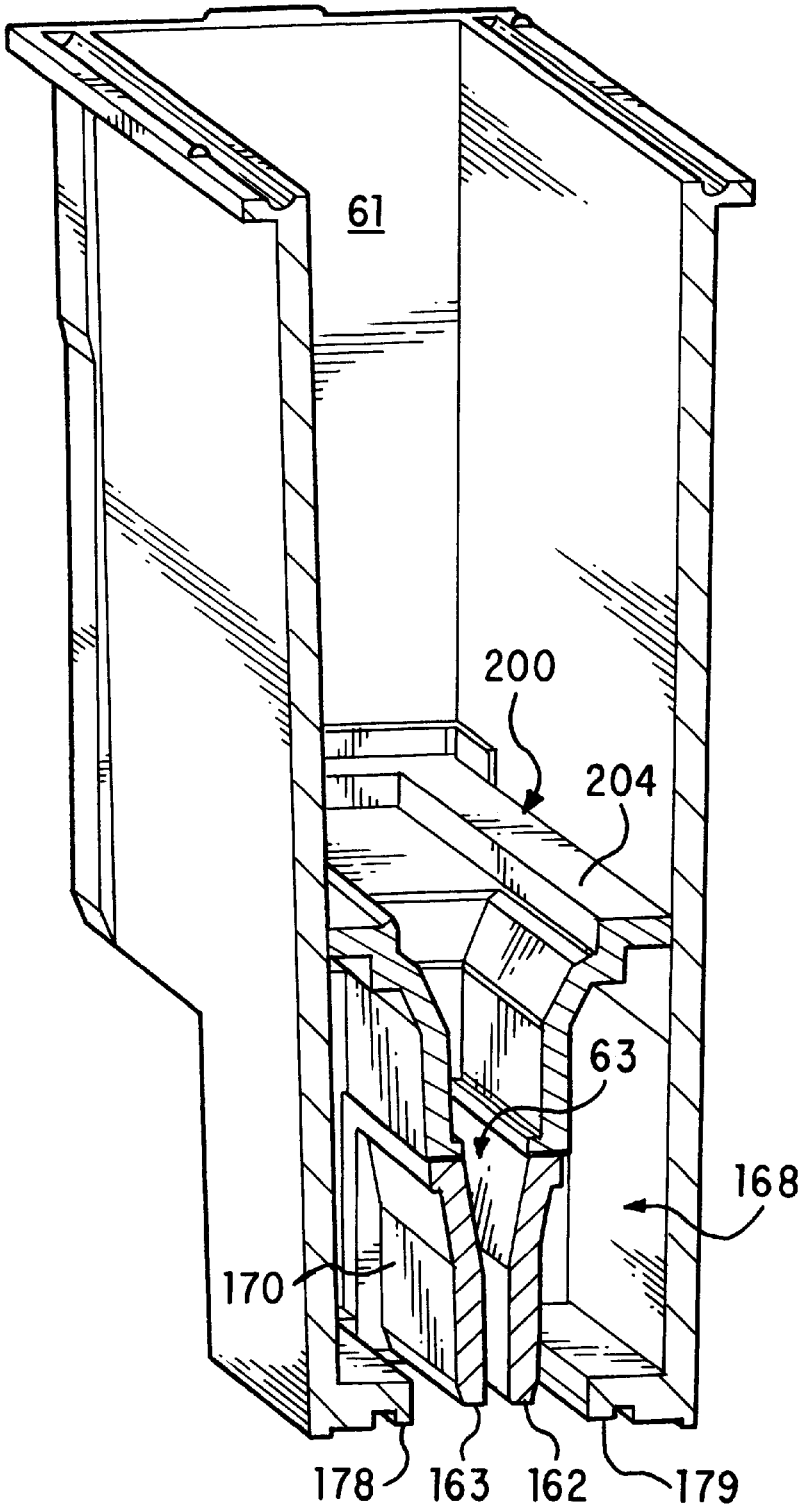
FIG. 10 is a cross-sectional, perspective view along line B—B of FIG. 3 illustrating an ink chamber for containing a pressure regulator and the ink conduit leading to the back surface of the substrate.

FIG. 10 is a cross-sectional, perspective view of the print cartridge of FIG. 3 with tape 80 removed along line B—B of FIG. 3 illustrating an ink chamber 61 for containing ink and a pressure regulator, the filter carrier 200 (with filter screen 202 removed) described below, walls 162 and 163, the ink conduit 63 defined by the filter carrier 200 and walls 162, 163 leading to the back surface of the substrate 88. Also shown are bubble accumulation chambers 168 and 170 defined and formed both by the walls of filter carrier 200 and the walls 162, 163. Filter carrier 200 is supported in cartridge 18 by support surfaces 190, 192. Filter carrier 200 is also supported walls 162, 163. One embodiment of a filter carrier is further described in U.S. patent application Ser. No. 08/846,970, filed Apr. 30, 1997, entitled "An Ink Delivery System That Utilizes a Separate Insertable Filter Carrier," which is herein incorporated by reference.

Another problem that occurs during the life of the print element is air out-gassing. Air builds up between the filter and the printhead during operation of the printhead. For printers that have a high use model, it would be preferable to have a larger volume between the filter and the printhead for the storage of air. For low use rate printers, this volume would be reduced.

Referring to FIG. 8 as the ink heats up, the solubility of air in the ink decreases, and air defuses out of the ink in the form of bubbles 112. In order for these bubbles 112 to not restrict the flow of ink, bubble accumulation chambers 168 and 170 are formed in the print cartridge body to accumulate these bubbles. Bubble accumulation chambers 168 and 170 are defined and formed both by the filter carrier 200 and the walls 162, 163. Hence, bubbles 112 will not interfere with the flow of ink through ink conduit 63 and around the edges of substrate 88 to the ink ejection chambers 94. Chambers 168 and 170 extend along the length of substrate 88 to be in fluid communication with all the ink inlet channels 132 formed in barrier layer 104 on substrate 88.

The volume of the bubble accumulation chambers described herein should be sufficient to store bubbles accumulated over the expected life of the print cartridge. Since the solubility curve for air in ink may differ for different types of ink, the required minimum volume of the bubble accumulation chambers will be dependent on the type of ink used. An acceptable range is approximately 1 to 5 cubic centimeters. In the preferred embodiment, these chambers 168 and 170 each have a capacity of 2 to 3 cubic centimeters; however, the capacity can be greater than or less than this preferred volume depending on the anticipated out-gassing.

Inkjet printheads are very sensitive to particulate contamination. To deal with this problem, a filter is required between the reservoir of ink 61 and the printhead 83. The filter prevents particulate contaminates from flowing from the ink reservoir 61 to the printhead 83 and clogging the printhead nozzles 82. Also, the filter prevents air bubbles from traveling from the printhead 83 into the reservoir 61. The filter separates the ink delivery portion 63 of the housing into two regions: (1) one upstream and in fluid communication with the reservoir 61 and (2) one downstream of the filter and in fluid communication with the printhead.

The mesh passage size is sufficiently small that while ink may pass through the passages of the mesh, air bubbles under normal atmospheric pressure will not pass through the mesh passages which are wetted by the ink. The required air bubble pressure necessary to permit bubbles to pass through the mesh, in this embodiment, about 30 inches of water, is well above that experienced by the pen under any typical storage, handling or operational conditions. As a result, the mesh also serves the function of an air check valve for the print cartridge.

The ink within each of the off-axis ink supply cartridges 31–34 may be at atmospheric pressure, whereby ink is drawn into each of print cartridges 18 by a negative pressure within each print cartridge determined by the regulator internal to each print cartridge as discussed above. Alternatively, the off-axis ink supply cartridges may be pressurized either constantly or intermittently. Constant pressurization of the various ink supply cartridges described has the following advantages over intermittent pressurization: (1) lower product cost/minimum product complexity by eliminating a pump station; (2) pressurizing the tubes reduces or eliminates air diffusion into tubes. Intermittent pressurization has the following advantages over constant pressurization: (1) Fluid seals and valves do not have to withstand constant pressure, resulting in improved reliability; (2) Ink supplies are less expensive, since the plastic shell does not need to be as strong. For a detailed discussion of pressurized ink supplies see U.S. patent application Ser. No. 08/706,121, filed Aug. 30, 1996, now U.S. Pat. No. 5,966, 155 entitled "Inkjet Printing System with Off-Axis ink Supply Having ink Path Which Does Not Extend above Print Cartridge," which is herein incorporated by reference.

In either the unpressurized or pressurized ink supply embodiments, the pressure regulator described above is used within the print cartridge for regulating the pressure of the ink chamber 61 within the print cartridge 18. An embodiment of a pressure regulator is more fully described in U.S. patent application Ser. No. 08/706,121, filed Aug. 30, 1996, entitled "Inkjet Printing System with Off-Axis ink Supply Having ink Path Which Does Not Extend above Print Cartridge."

Figure 11:
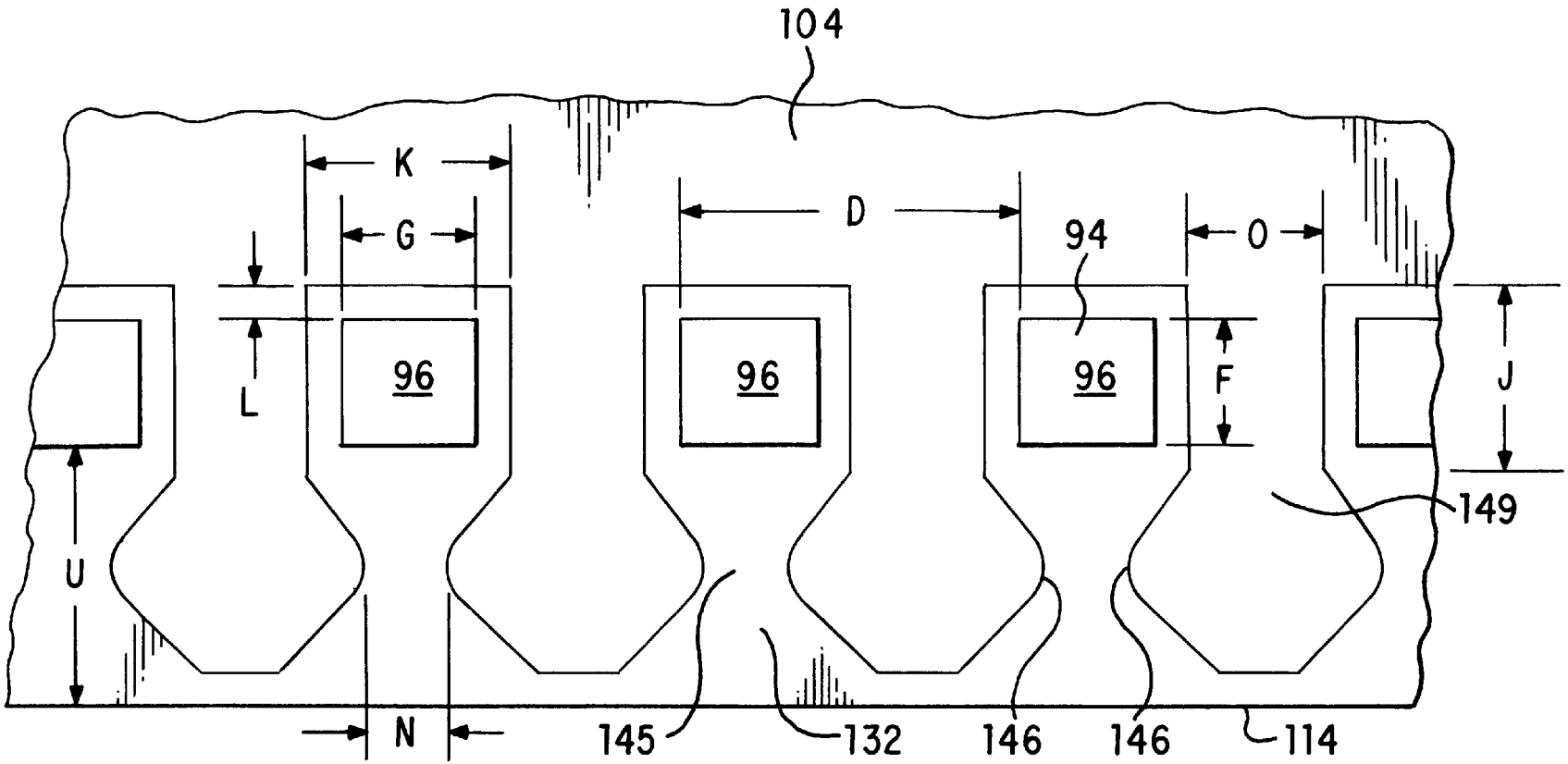
FIG. 11 is a top plan view of a portion of a printhead showing ink ejection chambers, the associated barrier structure and ink ejection elements.
Figure 12:
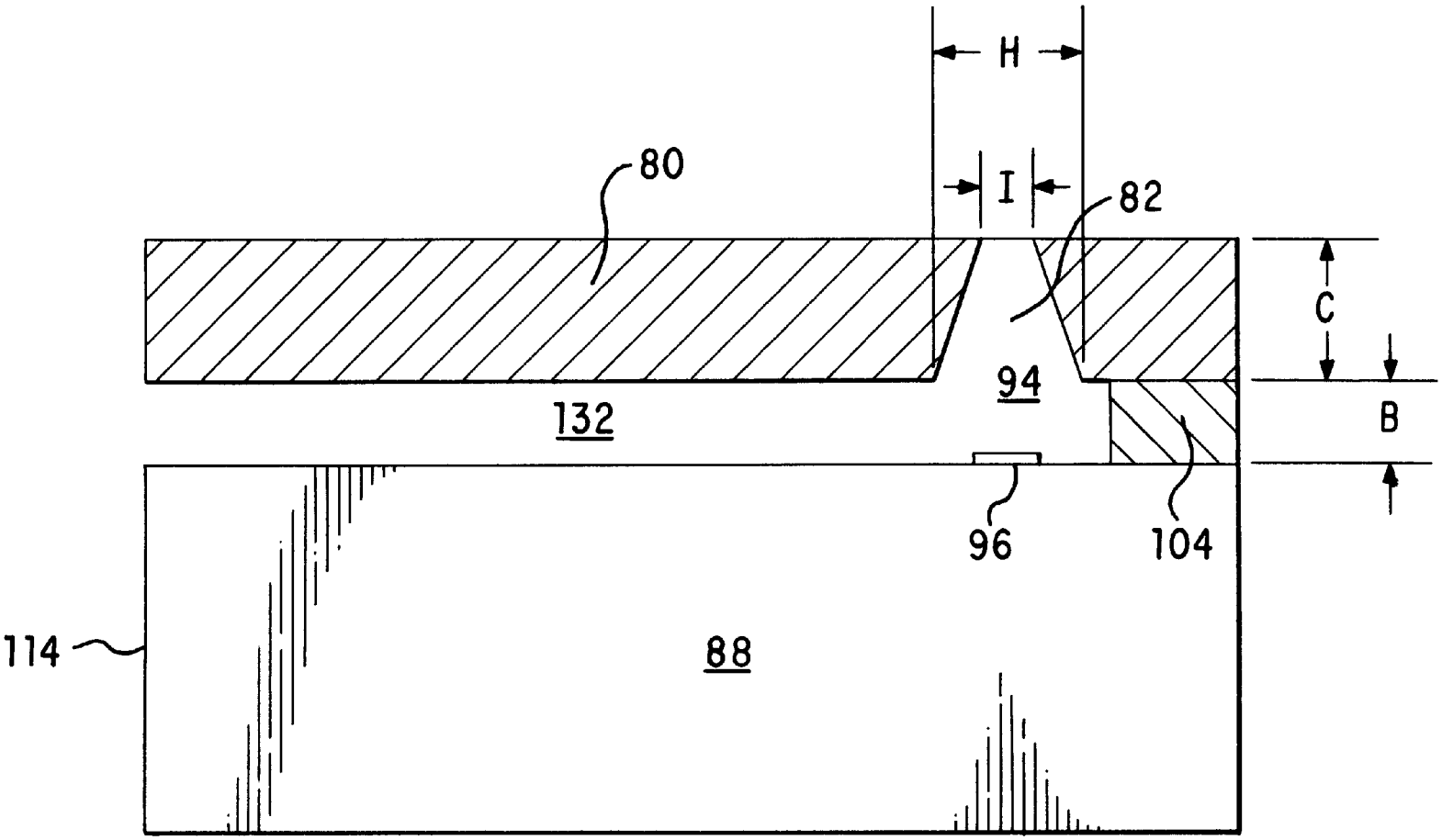
FIG. 12 is an elevational cross-sectional view of the printhead assembly of FIG. 9 showing the thickness of the barrier layer and the nozzle member.

FIGS. 11 and 12 show a printhead architecture that is advantageous when the printing of very high dot density, low drop volume, high drop velocity and high frequency ink ejection is required. However, at high dot densities and at high ink ejection rates cross-talk between neighboring ejection chambers becomes a serious problem. During the ejection of a single drop, initiated by an ink ejection element displaces ink out of nozzle 82 in the form of a drop. At the same time, ink is also displaced back into the ink inlet channel 132. The quantity of ink so displaced is often described as "blowback volume." The ratio of ejected volume to blowback volume is an indication of ejection efficiency. In addition to representing an inertial impediment to refill, blowback volume causes displacements in the menisci of neighboring nozzles. When these neighboring nozzles are fired, such displacements of their menisci cause deviations in drop volume from the nominally equilibrated situation resulting in non-uniform dots being printed. An embodiment of the present invention shown in the printhead assembly architecture of FIG. 11 is designed to minimize such cross-talk effects.

The ink ejection chambers 94 and ink inlet channels 132 are shown formed in barrier layer 104. Ink inlet channels 132 provide an ink path between the source of ink and the ink ejection chambers 94. The flow of ink into the ink inlet channels 132 and into the ink ejection chambers 94 is via ink flow around the side edges 114 of the substrate 88 and into the ink inlet channels 132. Alternatively, in a center feed design the flow of ink into the ink inlet channels 132 may be through a center slot in substrate 88 and into the ink inlet channels 132. The ink ejection chambers 94 and ink inlet channels 132 may be formed in the barrier layer 104 using conventional photo lithographic techniques. The barrier layer 104 may comprise any high quality photo resist, such as Vacrel™ or Parad™.

The relatively narrow constriction points or pinch point gaps 145 created by the pinch points 146 in the ink inlet channels 132 provide viscous damping during refill of the vaporization chambers 130 after firing. This viscous damping helps minimize cross-talk between neighboring vaporization chambers 94. The pinch points 146 also help control ink blow-back and bubble collapse after firing to improve the uniformity of ink drop ejection. The addition of "pen-insulas" 149 extending from the barrier body out to the edge of the substrate provided fluidic isolation of the vaporization chambers 94 from each other to prevent crosstalk.

The definition of the dimensions of the various elements shown in FIGS. 11 and 12 are provided in Table I.

TABLE I

DEFINITIONS FOR DIMENSIONS OF PRINTHEAD ARCHITECTURE

| Dimension | Definition |
|---|---|
| B | Barrier Thickness |
| C | Nozzle Member Thickness |
| D | Orifice/Ink Ejection Element Pitch |

TABLE I-continued

| DEFINITIONS FOR DIMENSIONS OF PRINTHEAD ARCHITECTURE | |
|---|---|
| Dimension | Definition |
| F | Ink Ejection Element Length |
| G | Ink Ejection Element Width |
| H | Nozzle Entrance Diameter |
| I | Nozzle Exit Diameter |
| J | Chamber Length |
| K | Chamber Width |
| L | Chamber Gap |
| N | Pinch Point Gap |
| O | Barrier Peninsula Width |
| U | Inlet Channel Length |

Table II lists the nominal values, as well as their preferred ranges, of some of the dimensions of the printhead assembly structure of FIGS. 11 and 12. It should be understood that the preferred ranges and nominal values of an actual embodiment will depend upon the intended operating environment of the printhead assembly, including the type of ink used, the operating temperature, the printing speed, and the dot density. The pitch D of the ejection chambers 94, provides for 600 dots per inch (dpi) printing using two offset rows of ink injection chambers 94.

TABLE II

| INK CHAMBER DIMENSIONS IN MICRONS | | | |
|---|---|---|---|
| Dimension | Minimum | Nominal | Maximum |
| B | 14 | 19 | 26 |
| C | 25 | 51 | 60 |
| D | N/A | 84.7 | N/A |
| F | 27 | 35 | 40 |
| G | 27 | 35 | 45 |
| H | 45 | 55 | 65 |
| I | 18 | 30 | 32 |
| J | 35 | 45 | 51 |
| K | 35 | 45 | 61 |
| L | 0 | 5 | 8 |
| N | 19 | 20 | 40 |
| O | 19 | 40 | 50 |
| U | 35 | 55 | 65 |

Figure 13:
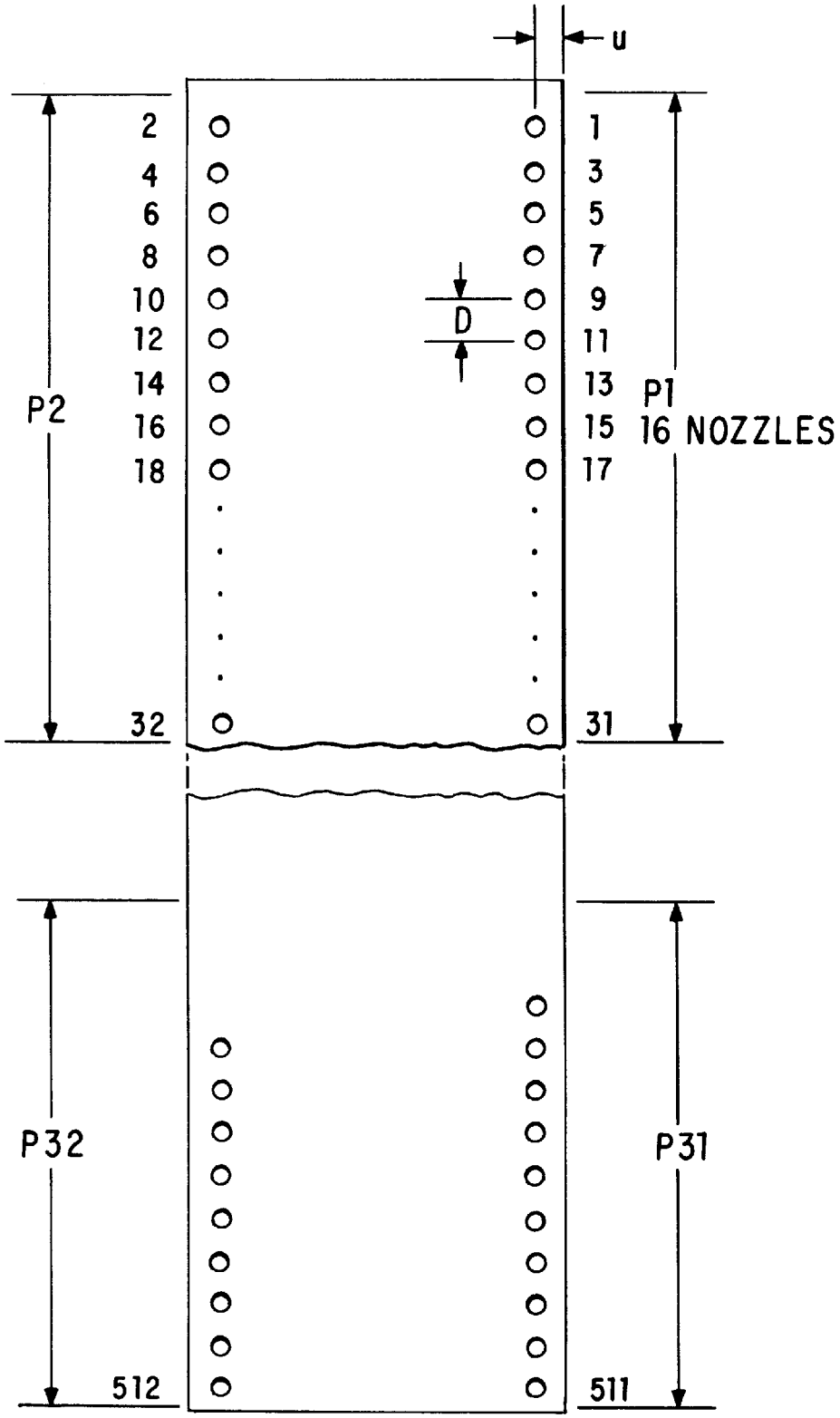
FIG. 13 is a top plan schematic view of a printhead nozzle array with a straight line of nozzles, parially showing the arrangement of primitives and the associated ink ejection elements and nozzles on a printhead, with the long axis of the array perpendicular to the scan direction of the printhead.

Referring to FIG. 13, the orifices 82 and ink ejection elements 96 in the nozzle member 79 of the printhead assembly are generally arranged in two major columns. For clarity of understanding, the orifices 82 and ink ejection elements 96 are conventionally assigned a number as shown, starting at the top right as the printhead assembly as viewed from the external surface of the nozzle member 79 and ending in the lower left, thereby resulting in the odd numbers being arranged in one column and even numbers being arranged in the second column. Of course, other numbering conventions may be followed, but the description of the firing order of the orifices 82 and ink ejection elements 96 associated with this numbering system has advantages. The orifices/ink ejection elements in each column are spaced 1/300 of an inch apart in the long direction of the nozzle member. The orifices and ink ejection elements in one column are offset from the orifice/ink ejection elements in the other column in the long direction of the nozzle member by 1/600 of an inch, thus, providing 600 dots per inch (dpi) printing when printing with both columns of nozzles.

For a number of reasons, all of the nozzles 82 cannot be energized simultaneously. That is, two adjacent nozzles are energized at slightly different times. The objective is to obtain a rectangular array of dots printed on the print medium. However, if the timing of two nozzles is off (by the normal delay), then a placement error of v*t will occur, where v is the scan velocity and t is the delay between firing two adjacent nozzles. If v*t is equal to an integral number of dot spacings, then that can be corrected by firing an extra initial dot for the "late" nozzle. However, v*t is normally some fraction of the dot spacing.

A prior solution to the timing problem is to provide a small offset or stagger between ink ejection chambers 94 within a primitive. The orifices 82, while generally aligned in two major columns as described with respect to FIG. 13, are further arranged in an offset or staggered pattern within each column and within each primitive. Within a single row or column of ink ejection elements, a small offset is provided between ink ejection elements. The stagger distance between two nozzles is equal to v*t. This small offset allows adjacent ink ejection elements 96 to be energized at slightly different times when the printhead assembly is scanning across the recording medium to allow all dots to land in a vertical column. There are different offset locations within the primitives, one for each of the address lines discussed below. This stagger helps to minimize current/power requirements associated with the firing ink ejection elements. Thus, although the ink ejection elements are energized at different times, the offset allows the ejected ink drops from different nozzles to be placed in the same horizontal position on the print media. However, with this solution the ink inlet channel 132 length or shelf length, U, is not the same for all ink injection elements. This means the refill time for all ink ejection chambers is also not the same. Accordingly, the refill speed cannot be maximized for all ink chambers. Further details are provided in U.S. Pat. No. 5,648,805 which is herein incorporated by reference.

In order for ink ejection elements 96 to have maximum performance, the distance from resistor to die edge needs to be minimized. This can only be accomplished by having a straight line of nozzles, which, however, creates the timing problem discussed above. The solution to the timing problem used in the present invention, is to rotate the printhead slightly, as described more fully below. This architecture allows a plurality of ink ejection elements 96 to be all placed parallel to and at substantially the same distance U from the edge 114 of the substrate 88. Accordingly, the inlet channel length, U, is the same for all ink injection elements. This means the refill time for all ink ejection chambers is approximately the same and can be maximized for all ink injection elements.

Figure 14:
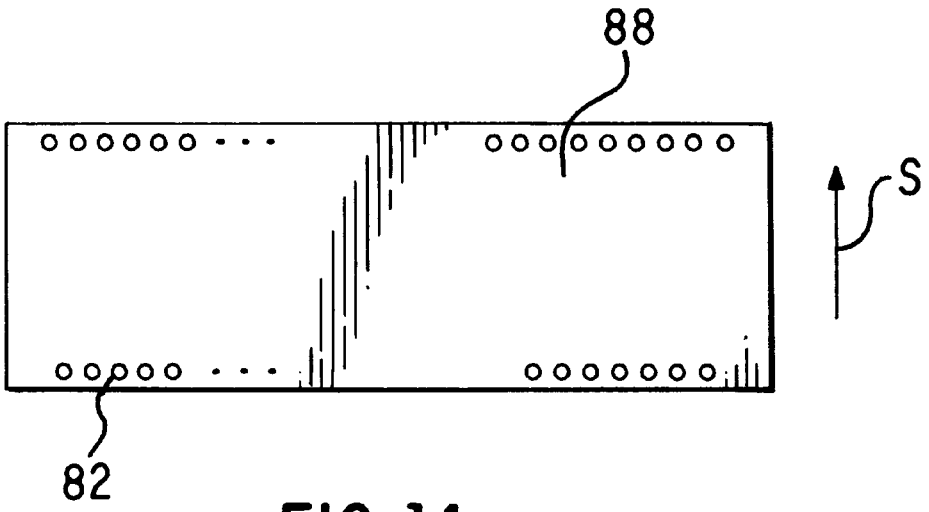
FIG. 14 is a simplified top plan view of a printhead nozzle array with a straight line of nozzles, with the array perpendicular to the scan direction of the printhead.
Figure 15A:
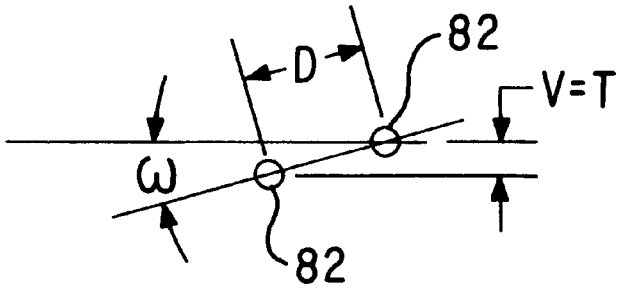
FIG. 15A is an enlargement of a portion of FIG. 15.
Figure 15:
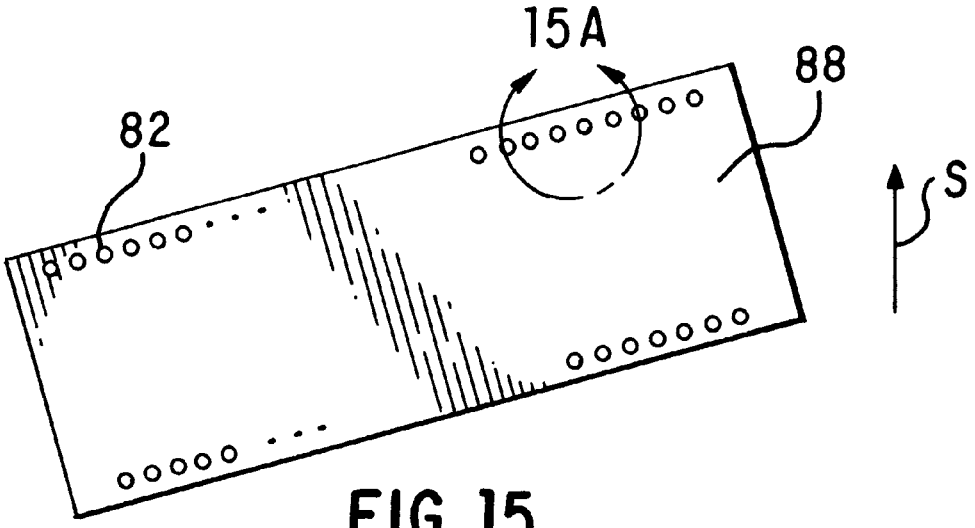
FIG. 15 is a top plan view similar to that of FIG. 14, but with the array rotated at a given angle with respect to the scan direction of the printhead.

Referring to FIGS. 14, 15 and 15A, the rotational angle ω of the substrate 88 is equal to the angle ω defined by the nozzle stagger. If the nozzle spacing is D, then the sine of the angle ω is equal to (v*t)/D. The angle of the cartridge rotation is the angle ω, where ω is arcsine (v*t)/D. The scan direction is indicated by S.

There are at least two ways to provide this rotation. One is to rotate the die 88 on the print cartridge 18 by the angle ω. This has the disadvantage that a special printhead assembly line must be provided to manufacture a cartridge with a rotated die.

Figure 16:
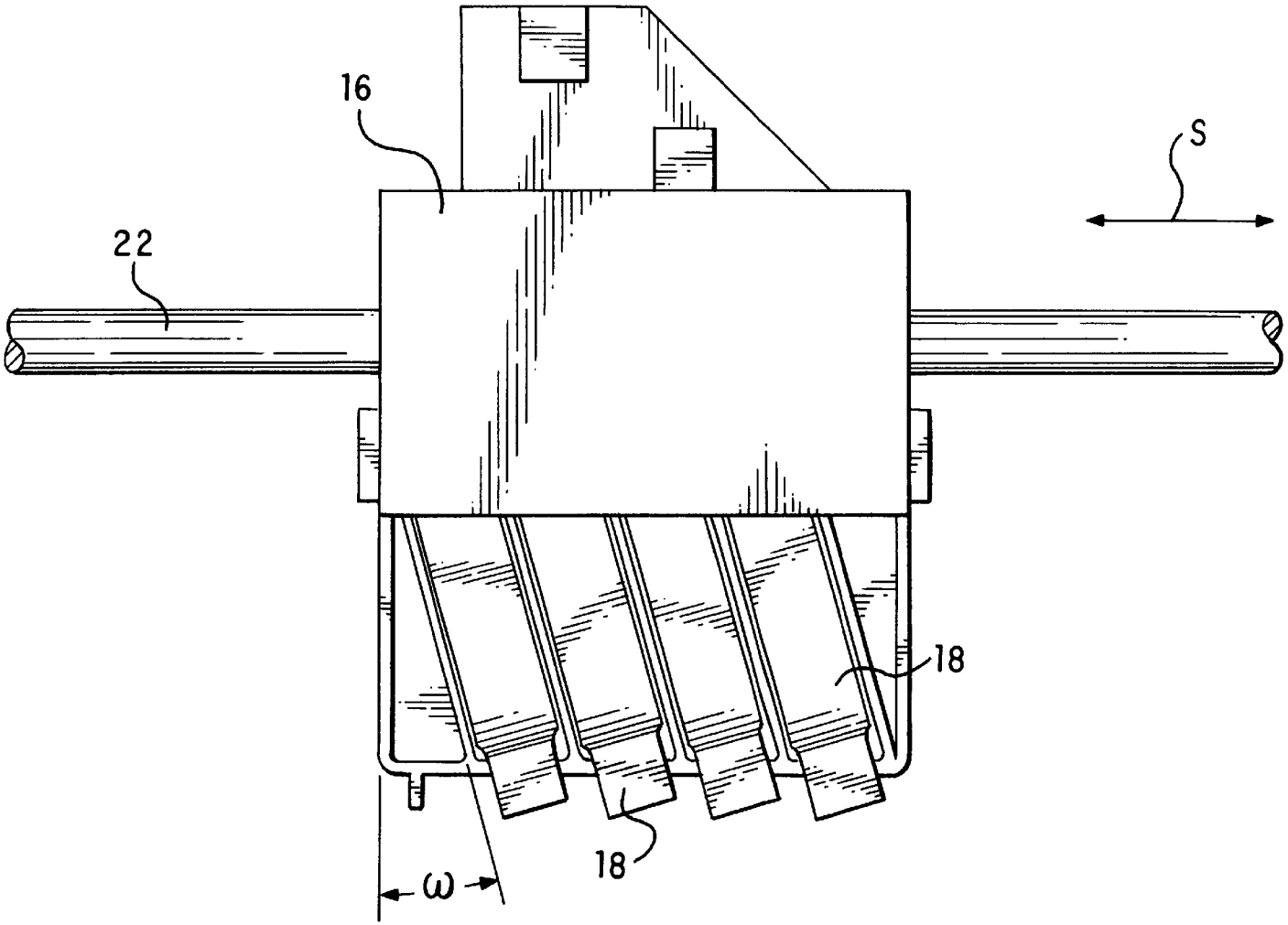
FIG. 16 is a top plan view of a cartridge holder, configured to contain a plurality of print cartridges at the angle depicted in FIG. 15A.

Referring to FIG. 16, an easier method to implement is simply to rotate the entire cartridge 18 by reconfiguring the carriage 16 to hold the print cartridges 18 in the proper angular orientation. The cartridges 18 are rotated about an axis of rotation from the side of the carriage 16 equal to the angle ω as shown in FIG. 15A.

Further details on the above-described methods are provided in U.S. Pat. No. 5,874,974, entitled "Reliable High Performance Drop Generator For an Inkjet Printhead," which is herein incorporated by reference.

Figure 17:
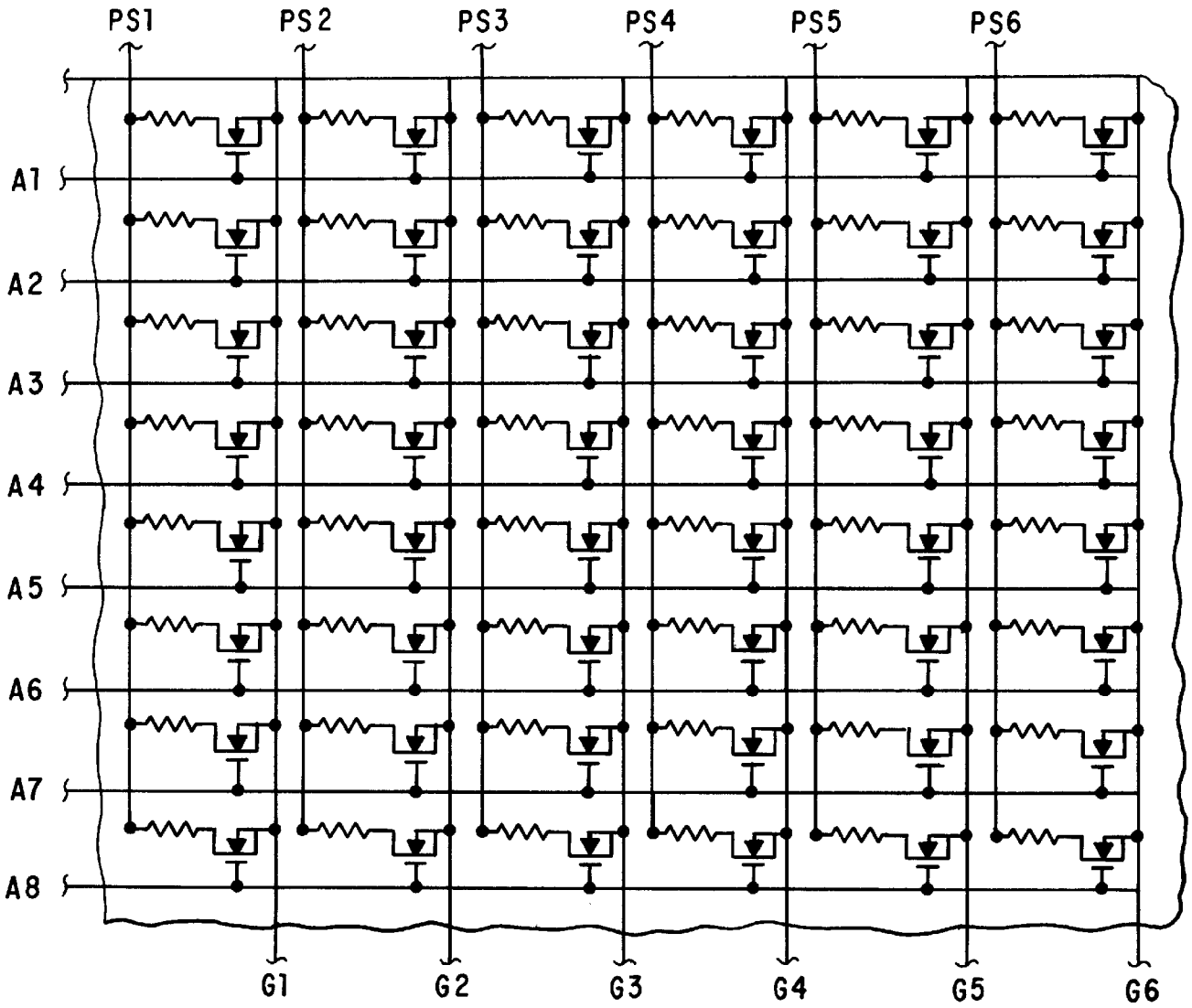
FIG. 17 is an enlarged schematic diagram of the address select lines and a portion of the associated ink ejection elements, primitive select lines and ground lines.

Referring now to the electrical schematic of FIG. 17, the interconnections for controlling the printhead assembly driver circuitry include separate address select or data lines, primitive select and primitive common interconnections. The ink ejection elements 96 are organized as 32 primitives (See FIG. 10) and 16 address lines. The driver circuitry of this particular embodiment comprises an array of 32 primitive lines, 32 primitive common lines, and 16 address select lines, to control 512 ink ejection elements. Any other combination of address lines and primitive select lines could be used. However, the number of nozzles within a primitive should be equal to the number of address lines. Shown in FIG. 17 are 8 of the 16 address lines (A1–A8), six of the 32 primitive lines (PS1–PS6), and six of the 32 primitive ground lines.

Each ink ejection element 96 is controlled by its own FET drive transistor, which shares its data or address select lines with 31 other ink ejection elements. Each ink ejection element is tied to other ink ejection elements by a common node primitive select. Consequently, firing a particular ink ejection element requires applying a control voltage at its "address select" terminal and an electrical power source at its "primitive select" terminal. Only one address select line is enabled at one time. This ensures that the primitive select and group return lines supply current to at most one ink ejection element at a time. Otherwise, the energy delivered to a heater ink ejection element would be a function of the number of ink ejection elements 96 being energized at the same time.

Figure 18:
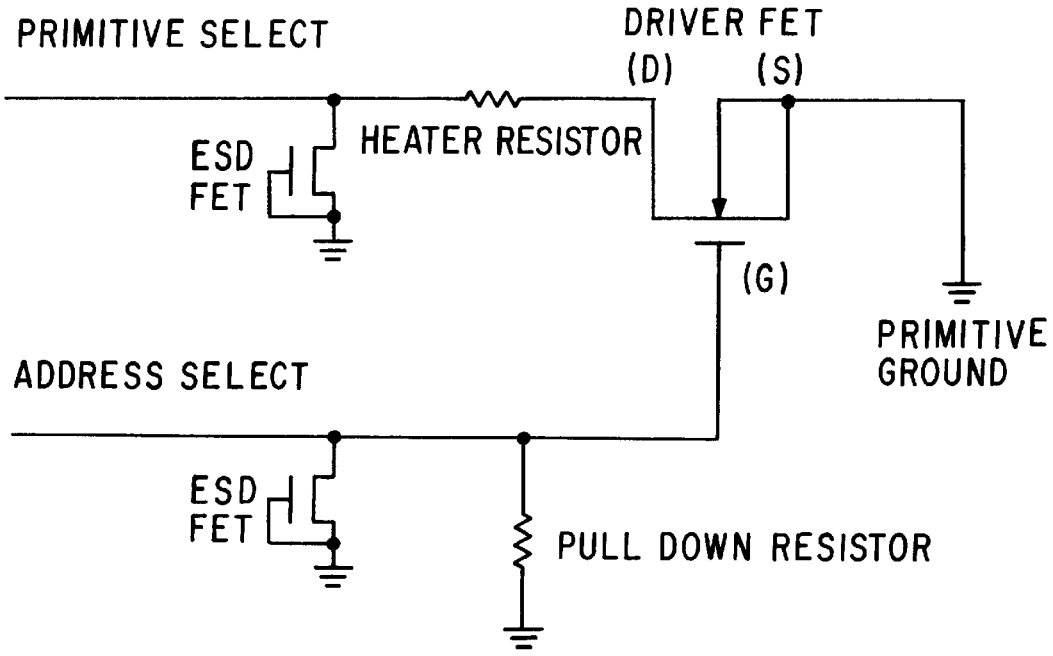
FIG. 18 is a schematic diagram of one ink ejection element of FIG. 17 and its associated address line, drive transistor, primitive select line and ground line.

FIG. 18 is a schematic diagram of an individual ink ejection element and its FET drive transistor. As shown, address select and primitive select lines also contain transistors for draining unwanted electrostatic discharge and a pull-down resistor to place all unselected addresses in an off state.

Figure 19:
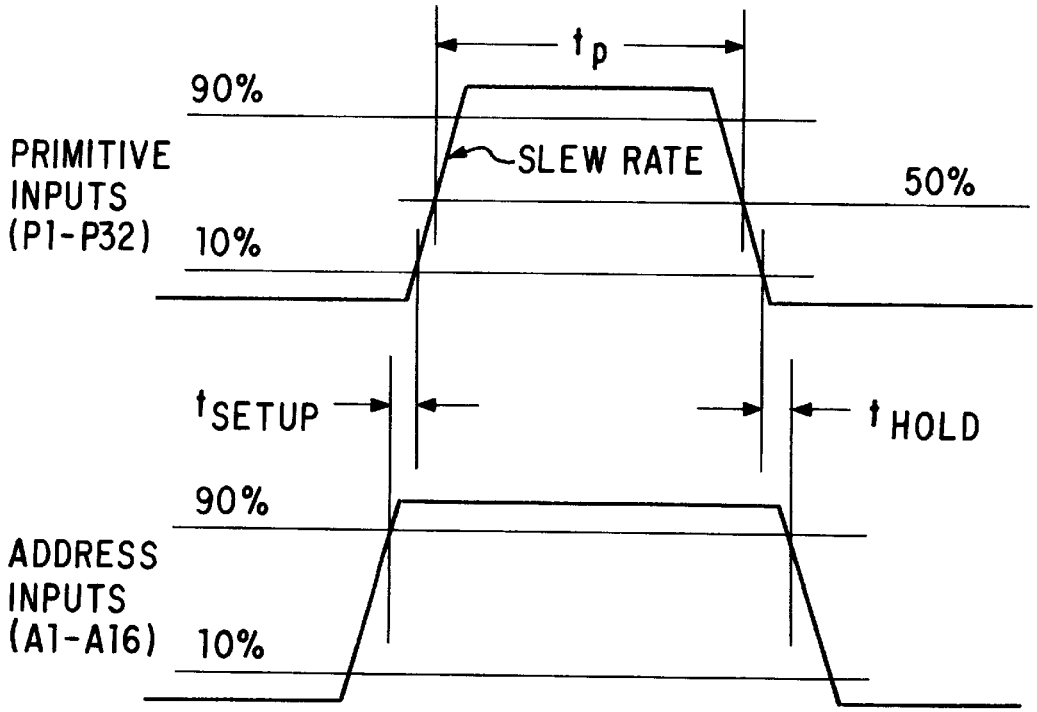
FIG. 19 is a schematic timing diagram for the setting of the address select and primitive select lines.

The address select lines are sequentially turned on via printhead assembly interface circuitry according to a firing order counter located in the printer and sequenced (independently of the data directing which ink ejection element is to be energized) from A1 to A16 when printing form left to right and from A16 to A1 when printing from right to left. The print data retrieved from the printer memory turns on any combination of the primitive select lines. Primitive select lines (instead of address select lines) are used in the preferred embodiment to control the pulse width. Disabling address select lines while the drive transistors are conducting high current can cause avalanche breakdown and consequent physical damage to MOS transistors. Accordingly, the address select lines are "set" before power is applied to the primitive select lines, and conversely, power is turned off before the address select lines are changed as shown in FIG. 19.

In response to print commands from the printer, each primitive is selectively energized by powering the associated primitive select interconnection. To provide uniform energy per heater ink ejection element only one ink ejection element is energized at a time per primitive. However, any number of the primitive selects may be enabled concurrently. Each enabled primitive select thus delivers both power and one of the enable signals to the driver transistor. The other enable signal is an address signal provided by each address select line only one of which is active at a time. Each address select line is tied to all of the switching transistors so that all such switching devices are conductive when the interconnection is enabled. Where a primitive select interconnection and an address select line for a heater ink ejection element are both active simultaneously, that particular heater ink ejection element is energized. Thus, firing a particular ink ejection element requires applying a control voltage at its "address select" terminal and an electrical power source at its "primitive select" terminal. Only one address select line is enabled at one time. This ensures that the primitive select and group return lines supply current to at most one ink ejection element at a time. Otherwise, the energy delivered to a heater ink ejection element would be a function of the number of ink ejection elements 96 being energized at the same time.

Figure 20:
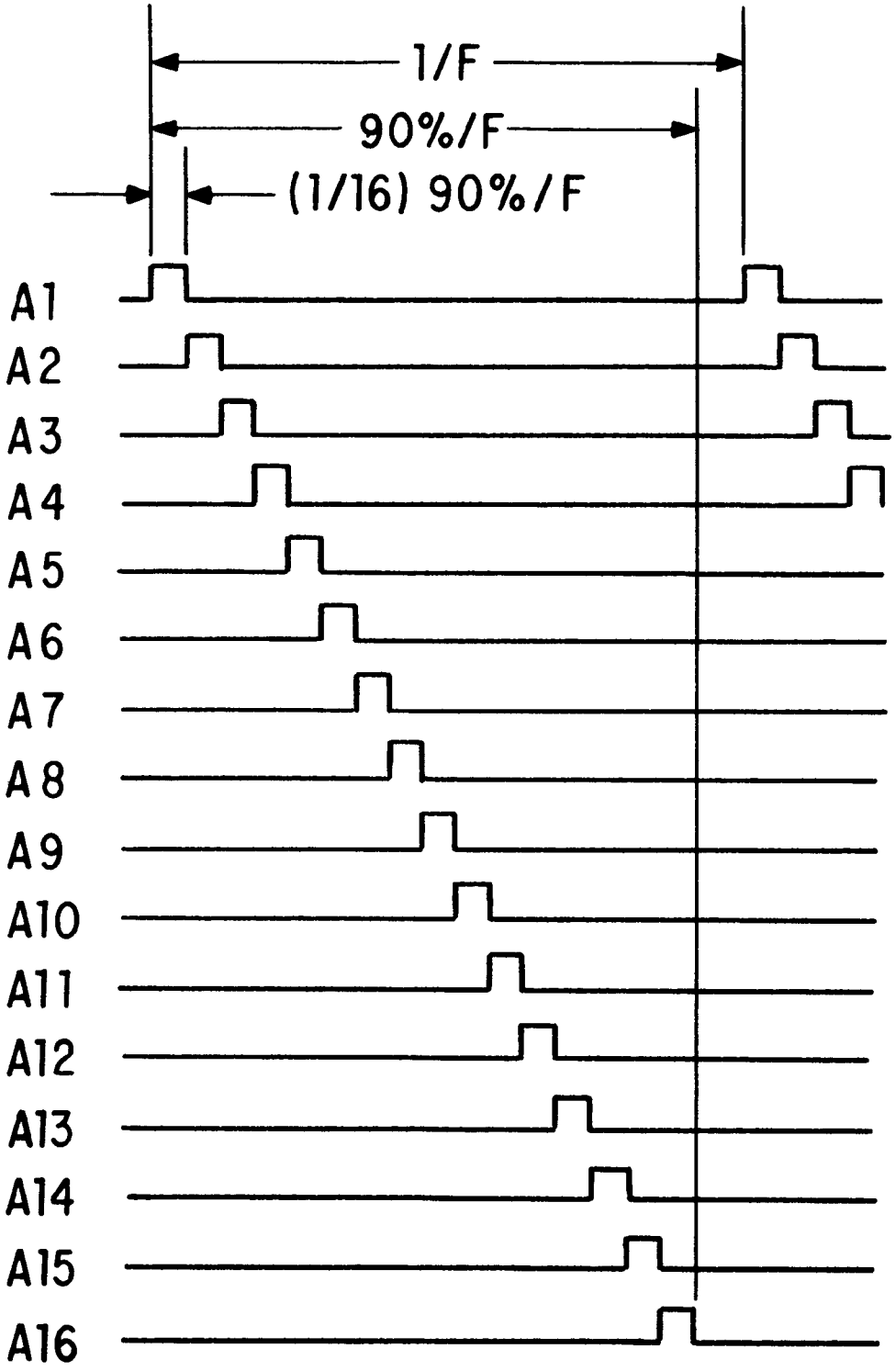
FIG. 20 is a schematic diagram of the firing sequence for the address select lines when the printer carriage is moving from left to right.

FIG. 20 shows the firing sequence when the print carriage is scanning from left to right. The firing sequence is reversed when scanning from right to left. A brief rest period of approximately ten percent of the period is allowed between cycles. This rest period prevents address select cycles from overlapping due to printer carriage velocity variations.

Figure 21:
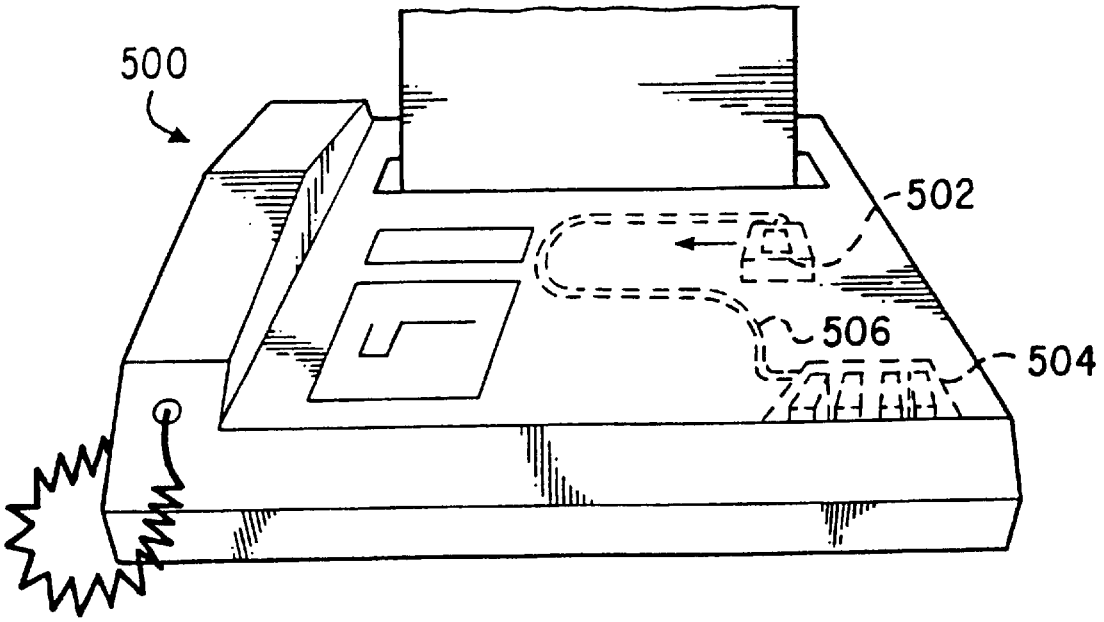
FIG. 21 is a perspective view of a facsimile machine showing one embodiment of the ink delivery system in phantom outline.

The present invention allows a wide range of product implementations other than that illustrated in FIG. 2. For example, such ink delivery systems may be incorporated into an inkjet printer used in a facsimile machine 500 as shown in FIG. 21, where a scanning cartridge 502 and an off-axis ink delivery system 504, connected via tube 506, are shown in phantom outline.

Figure 22:
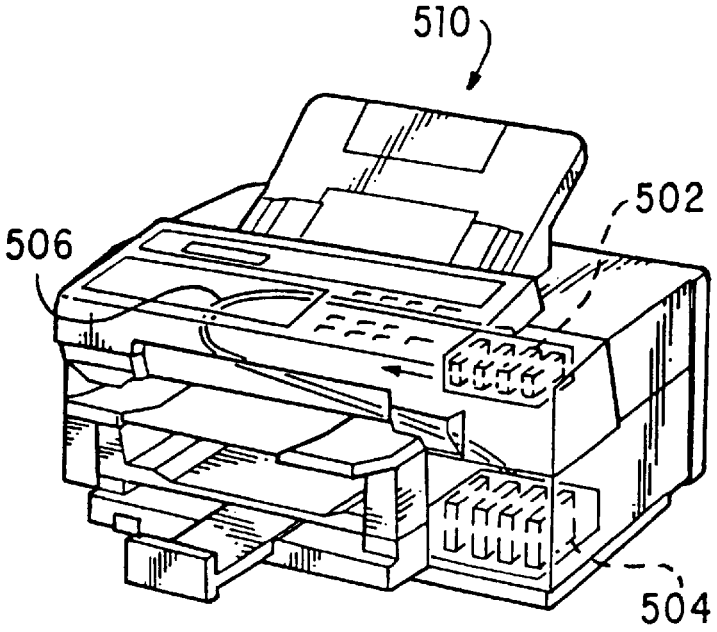
FIG. 22 is a perspective view of a copier, which may be a combined facsimile machine and printer, illustrating one embodiment of the ink delivery system in phantom outline.

FIG. 22 illustrates a copying machine 510, which may also be a combined facsimile/copying machine, incorporating an ink delivery system described herein. Scanning print cartridges 502 and an off-axis ink supply 504, connected via tube 506, are shown in phantom outline.

Figure 23:
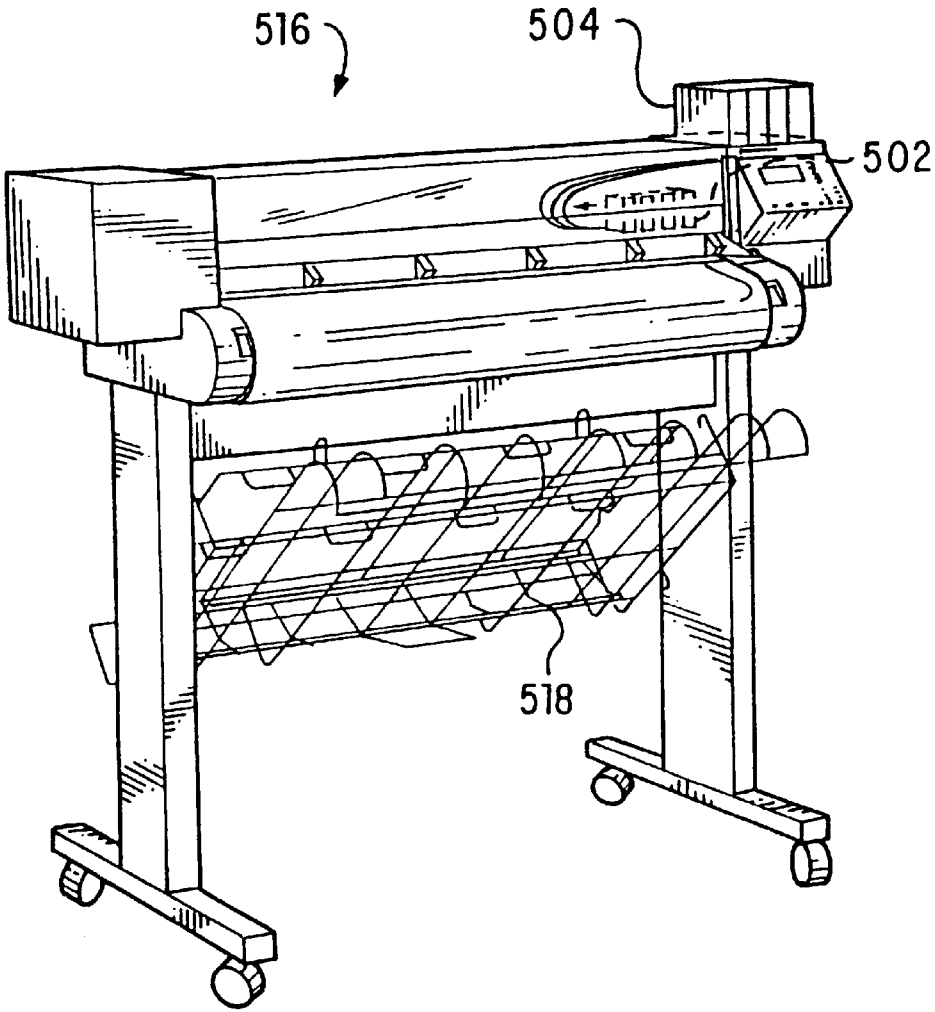
FIG. 23 is a perspective view of a large-format inkjet printer illustrating one embodiment of the ink delivery system.

FIG. 23 illustrates a large-format printer 516 which prints on a wide, continuous paper roll supported by tray 518. Scanning print cartridges 502 are shown connected to the off-axis ink supply 504 via tube 506.

Facsimile machines, copy machines, and large format machines tend to be shared with heavy use. They are often used unattended and for large numbers of copies. Thus, large capacity (50–500 cc) ink supplies will tend to be preferred for these machines. In contrast, a home printer or portable printer would be best with low capacity supplies in order to minimize product size and cost.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An inkjet printing device comprising:

a scanning carriage having a scan direction; and a print cartridge mounted on the scanning carriage, the print cartridge comprising:

a housing having an internal ink chamber in fluid communication with an internal ink conduit;

a substrate having a plurality of outer edges, a front surface and a back surface, said substrate being mounted on said housing and including a plurality of individual ink ejection chambers defined by a barrier layer formed on the front surface of said substrate and having an ink ejection element in each of said ink ejection chambers, said ink ejection chambers forming a straight linear array substantially along a length of the substrate, each ink ejection chamber having an ink inlet channel of a same length, said back surface having a portion across which ink flows;

an ink channel fluidically connecting said internal ink conduit with said ink inlet channels; and a plurality of ink orifices aligned with said ink ejection chambers, wherein the print cartridge is mounted on the scanning carriage at a fixed angular position such that the straight linear array of ink ejection chambers is not perpendicular to the scan direction of the carriage.

2. The inkjet printing device of claim 1, wherein said internal ink conduit has an opening proximate to said back surface of said substrate, and wherein ink flows from said opening into said ink channel and across the portion of the back surface of said substrate.

3. The inkjet printing device of claim 1, wherein said internal ink conduit is defined by a first wall and a second wall, each wall having an end terminating proximate to the back surface of said substrate, so that ink flows through said ink conduit into said ink channel and across at least the portion of said back surface of said substrate and into said ink inlet channels.

4. The inkjet printing device of claim 1, wherein said ink channel allows said ink to flow across at least the portion of the back surface of said substrate and around one or more outer edges of said substrate and into said ink inlet channels.

5. The inkjet printing device of claim 1, wherein said ink channel allows said ink to flow across at least the portion of the back surface of said substrate and through a slot formed in said substrate and into said ink inlet channels.

6. The inkjet printing device of claim 3, wherein a gap between said back surface of said substrate and the ends of said first wall and said second wall is about 3 to 7 mils.

7. The inkjet printing device of claim 1, further including a bubble accumulation chamber for accumulating bubbles caused by warming of the ink by said substrate, said bubble accumulation chamber being in fluid communication with said ink inlet channels and said ink channel.

8. The inkjet printing device of claim 1, further comprising:

an external supply of ink, and a pressure regulator in said internal ink chamber, said pressure regulator being in fluid communication with said internal ink chamber and said external supply of ink.

9. The inkjet printing device of claim 8, wherein said external supply of ink is releasably affixed to said housing.

10. The inkjet printing device of claim 8, wherein said external supply of ink is integral to said housing.

11. The inkjet printing device of claim 1, wherein said inlet channel length is minimized to allow high speed refill of the ink ejection chamber.

12. The inkjet printing device of claim 1, wherein said inlet channel length is less than 60 microns.

13. The inkjet printing device of claim 1, wherein said inlet channel length is less than 40 microns.

14. The inkjet printing device of claim 1, wherein the print cartridge is skewed with respect to the scanning carriage such that the straight linear array of ink ejection chambers is not perpendicular to the scan direction of the carriage.

15. An inkjet print cartridge comprising:

a housing having an internal ink chamber in fluid communication with an internal ink conduit;

a first wall and a second wall defining said internal ink conduit, said first and second walls being separate from walls forming said housing;

a substrate, having a plurality of outer edges, a front surface and a back surface, mounted on said housing and including a plurality of individual ink ejection chambers defined by a barrier layer formed on the front surface of said substrate and having an ink ejection element in each of said ink ejection chambers, each of said ink ejection chambers having an ink inlet channel, said back surface having a portion across which ink flows;

an ink channel fluidically connecting said internal ink conduit with said ink inlet channels; and a plurality of ink orifices aligned with said ink ejection chambers, wherein said internal ink conduit has an opening proximate to said back surface of said substrate to allow ink to flow from said opening into said ink channel and across the portion of the back surface of said substrate.

wherein said ink channel allows said ink to flow across at least the portion of the back surface of said substrate and through a slot formed in said substrate and into said ink inlet channels.

16. The inkjet print cartridge of claim 15, wherein said each of said first and second walls has an end terminating proximate to the back surface of said substrate, so that ink flows through said internal ink conduit into said ink channel and across at least the portion of said back surface of said substrate and into said ink inlet channels.

17. The inkjet print cartridge of claim 16, wherein a gap between said back surface of said substrate and the ends of said first wall and said second wall is about 3 to 7 mils.

18. The inkjet print cartridge of claim 14, wherein said ink channel allows said ink to flow across at least the portion of the back surface of said substrate and around one or more outer edges of said substrate and into said ink inlet channels.

19. An inkjet print cartridge comprising:

a housing having an internal ink chamber in fluid communication with an internal ink conduit;

a first wall and a second wall defininf said internal ink conduit, said first and second walls being seperate from walls forming said housing;

a substrate, having a plurality of outer edges, a front surface and a back surface, mounted on said housing and including a plurality of individual ink ejection chambers defined by a barrier layer formed on the front surface of said substrate and having an ink ejection element in each of said ink ejection chambers, each of said ink ejection chambers having an ink inlet channel, said back surface having a portion across which ink flow;

an ink channel fluidically connecting said internal ink conduit with said ink inlet channels;

a plurality of ink orifices aligned with said ink ejection chambers, wherein said internal ink conduit has an opening proximate to said back surface of said substrate to allow ink to flow from said opening into said ink channel and across the portion of the back surface of said substrate; and

20. An inkjet print cartridge comprising:

a housing having an internal ink chamber in fluid communication with an internal ink conduit;

a first wall and a second wall defininf said internal ink conduit, said first and second walls being seperate from walls forming said housing;

a substrate, having a plurality of outer edges, a front surface and a back surface, mounted on said housing and including a plurality of individual ink ejection chambers defined by a barrier layer formed on the front surface of said substrate and having an ink ejection element in each of said ink ejection chambers, each of said ink ejection chambers having an ink inlet channel, said back surface having a portion across which ink flow;

an ink channel fluidically connecting said internal ink conduit with said ink inlet channels;

a plurality of ink orifices aligned with said ink ejection chambers, wherein said internal ink conduit has an opening proximate to said back surface of said substrate to allow ink to flow from said opening into said ink channel and across the portion of the back surface of said substrate;

an external supply of ink; and a pressure regulator in said internal ink chamber, said pressure regulator being in fluid communication with said internal ink chamber and said external supply of ink.

21. The inkjet print cartridge of claim 20, wherein said external supply of ink is releasably affixed to said housing.

22. The inkjet print cartridge of claim 20, wherein said external supply of ink is integral to said housing.

23. The inkjet print cartridge of claim 15, wherein each of the ink inlet channels has a same length.

24. The inkjet print cartridge of claim 23, wherein said ink inlet channel length is minimized to allow high speed refill of the ink ejection chamber.

25. The inkjet print cartridge of claim 23, wherein said ink inlet channel length is less than 60 microns.

26. The inkjet print cartridge of claim 23, wherein said ink inlet channel length is less than 40 microns.

27. An inkjet printer comprising:

a scanning carriage for scanning along a scan direction;

a housing mounted in said scanning carriage, and having an internal ink chamber in fluid communication with an internal ink conduit;

a pressure regulator in said internal ink chamber, and in fluid communication with said internal ink chamber and an external supply of ink;

a substrate having a front surface and a back surface, said substrate being mounted on said housing and having a plurality of individual ink ejection chambers defined by a barrier layer formed on the front surface of said substrate and having an ink ejection element in each of said ink ejection chambers, said ink ejection chambers forming a straight linear array substantially along a length of the substrate, each ink ejection chamber having an ink inlet channel of a same length;

an ink channel fluidically connecting said internal ink conduit with said ink inlet channels; and a plurality of ink orifices aligned with said ink ejection chambers, wherein the housing is skewed with respect to the scanning carriage at a fixed angular position such that the straight linear array of ink ejection chambers is not perpendicular to the scan direction of the carriage.

28. The inkjet printer of claim 27 wherein said pressure regulator includes:

a valve having an inlet and outlet, with the outlet in fluid communication with the housing;

a flexible member within the housing, the flexible member having a reference surface and an ink surface, the reference surface in communication with an outside atmosphere, the ink surface in fluid communication with the housing, a difference in pressure between the outside atmosphere and the housing causing the flexible member to bias toward the ink surface;

an actuator that receives a force from the ink surface of the flexible member, the actuator actuating the valve based upon a differential pressure between the reference surface and the outside atmosphere;

a source of ink for replenishing the printhead; and an ink passageway for connecting the source of ink and the valve inlet.

29. The inkjet printer of claim 27 wherein said regulator includes:

a valve having an inlet and outlet, with the outlet in fluid communication with the housing;

a flexible member within the housing, the flexible member having a reference surface and an ink surface, the reference surface in communication with an outside atmosphere, the ink surface in fluid communication with the housing, a difference in pressure between the outside atmosphere and the housing causing the flexible member to bias toward the ink surface;

an actuator that receives a force from the ink surface of the flexible member, the actuator actuating the valve based upon the differential pressure between the reference surface and the outside atmosphere; a source of ink for replenishing the printhead; and an ink passageway for connecting the source of ink and the valve inlet.

30. An inkjet printer comprising:

a scanning carriage;

a housing mounted in said scanning carriage and having an internal ink chamber in fluid communication with an internal ink conduit;

a first wall and a second wall defining said internal ink conduit, said first and second walls being separate from walls forming said housing;

a pressure regulator in said internal ink chamber and in fluid communication with said internal ink chamber and an external supply of ink;

a substrate, having a front surface and a back surface, mounted on said housing and having a plurality of individual ink ejection chambers defined by a barrier layer formed on the front surface of said substrate and having an ink ejection element in each of said ink ejection chambers, each of said ink ejection chambers having an ink inlet channel, said back surface having a portion across which ink flows;

an ink channel fluidically connecting said ink conduit with said ink inlet channels; and a nozzle member having a plurality of ink orifices formed therein, said nozzle member being positioned to overlie said barrier layer with said orifices aligned with said ink ejection chambers, wherein said internal ink conduit has an opening proximate to said back surface of said substrate to allow ink to flow from said opening into said ink channel and across the portion of the back surface of said substrate.

31. A method of printing comprising:

providing a print cartridge mounted on a scanning carriage, the scanning carriage moving along a scan direction, the print cartridge comprising:

a housing having an internal ink chamber in fluid communication with an internal ink conduit;

a pressure regulator in the internal ink chamber, the pressure regulator in fluid communication with the internal ink chamber and an external ink supply;

a substrate mounted on the housing, the substrate having a front surface, a back surface, and a plurality of ink ejection chambers, the plurality of ink ejection chambers forming a straight linear array substantially along a length of the substrate, each ink ejection chamber having an ink inlet channel of a same length;

an ink channel fluidically connecting the internal ink conduit with the ink inlet channels; and a plurality of ink orifices, each ink orifice being aligned with a respective ink ejection chamber;

supplying ink from the external ink supply through the pressure regulator of the print cartridge into the internal ink chamber through the ink channel and ink inlet channels and into the ink ejection chambers of the substrate; and scanning the carriage along the scan direction while expelling ink onto a recording medium, wherein the print cartridge is mounted on the scanning carriage at a fixed angular position such that the straight linear array of ink ejection chambers is not perpendicular to the scan direction of the carriage.

32. The method of claim 31, wherein the print cartridge is skewed with respect to the scanning carriage such that the straight linear array of ink ejection chambers is not perpendicular to the scan direction of the carriage.

33. The method of claim 31, wherein the internal ink conduit of the print cartridge is defined by a first wall and a second wall, the first and second walls being separate from walls forming the housing and each having an end terminating proximate to the back surface of the substrate, so that ink flows through the internal ink conduit into the ink channel across the back surface of the substrate and into the ink inlet channels.

34. The method of claim 33, wherein a gap between the back surface of the substrate and the ends of the first wall and the second wall is about 3 to 7 mils.

* * * * *

UNITED STATES PATENT AND TRADEMARK OFFICE

CERTIFICATE OF CORRECTION

PATENT NO. : 6,183,078 B1
DATED : February 6, 2001
INVENTOR(S) : Pietrzyk et al.

It is certified that error appears in the above-identified patent and that said Letters Patent is hereby corrected as shown below:

Column 16,
Line 30, after "claim" delete "14" and insert in lieu thereof -- 15 --.
Line 37, after "wall" delete "defininf" and insert in lieu thereof -- defining --.
Line 56, after "of said substrate; and" insert -- a bubble accumulation chamber for accumulating bubbles caused by warming of the ink by said substrate, said bubble accumulating chamber being in fluid communication with said ink inlet channels and said ink channel. --
Line 60, after "wall" delete "defininf" and insert in lieu thereof -- defining --.

Signed and Sealed this

First Day of January, 2002

*Attest:*

*Attesting Officer*

JAMES E. ROGAN
*Director of the United States Patent and Trademark Office*